US011453231B2

(12) United States Patent
Kadokura et al.

(10) Patent No.: US 11,453,231 B2
(45) Date of Patent: Sep. 27, 2022

(54) RECORDING MEDIUM AND RECORDING DEVICE

(71) Applicants: KABUSHIKI KAISHA TOSHIBA, Minato-ku (JP); TOSHIBA INFRASTRUCTURE SYSTEMS & SOLUTIONS CORPORATION, Kawasaki (JP)

(72) Inventors: Yuuma Kadokura, Kawasaki (JP); Nobuki Nemoto, Kawasaki (JP)

(73) Assignees: KABUSHIKI KAISHA TOSHIBA, Minato-ku (JP); TOSHIBA INFRASTRUCTURE SYSTEMS & SOLUTIONS CORPORATION :, Kawasaki (JP)

( * ) Notice: Subject to any disclaimer, the term of this patent is extended or adjusted under 35 U.S.C. 154(b) by 465 days.

(21) Appl. No.: 16/445,629

(22) Filed: Jun. 19, 2019

(65) Prior Publication Data

US 2019/0389235 A1 Dec. 26, 2019

(30) Foreign Application Priority Data

Jun. 20, 2018 (JP) ..... JP2018-116753

(51) Int. Cl.

| | |
|---|---|
| ***B41M 5/34*** | (2006.01) |
| ***B41M 5/46*** | (2006.01) |
| ***B41M 5/42*** | (2006.01) |

(52) U.S. Cl.

CPC ..... *B41M 5/34* (2013.01); *B41M 5/46* (2013.01); *B41M 5/42* (2013.01); *B41M 2205/04* (2013.01); *B41M 2205/38* (2013.01); *B41M 2205/40* (2013.01); *B41M 2205/42* (2013.01)

(58) Field of Classification Search

CPC . B41M 5/34; B41M 5/42; B41M 5/46; B41M 2205/04; B41M 2205/38; B41M 2205/40; B41M 2205/42

See application file for complete search history.

(56) References Cited

U.S. PATENT DOCUMENTS

| | | | | |
|---|---|---|---|---|
| 2004/0101789 | A1* | 5/2004 | Kurihara | B41M 5/305 430/336 |
| 2005/0181498 | A1 | 8/2005 | Lutz et al. | |
| 2010/0087316 | A1 | 4/2010 | Day et al. | |

(Continued)

FOREIGN PATENT DOCUMENTS

| | | |
|---|---|---|
| JP | 2004-020596 | 1/2004 |
| JP | 3509246 | 3/2004 |

(Continued)

*Primary Examiner* — Gerard Higgins

(74) *Attorney, Agent, or Firm* — Oblon, McClelland, Maier & Neustadt, L.L.P.

(57) ABSTRACT

A recording medium according to an embodiment includes a base material; a first color developing layer that is laminated on the base material, and absorbs light having a given wavelength to develop a color; a photothermal conversion layer that is laminated closer to an incident side of the light than the first color developing layer, transmits visible light, and absorbs the light for photothermal conversion; and a second color developing layer that is laminated closer to the incident side of the light than the first color developing layer, transmits visible light and the light, and develops a color by heat converted by the photothermal conversion layer.

7 Claims, 27 Drawing Sheets

(56) References Cited

U.S. PATENT DOCUMENTS

| | | | | |
|---|---|---|---|---|
| 2010/0099556 | A1 | 4/2010 | Vetterling et al. | |
| 2012/0218540 | A1 | 8/2012 | Ishimi et al. | |
| 2013/0021421 | A1 | 1/2013 | Ishikawa et al. | |
| 2017/0253065 | A1* | 9/2017 | Nakano | B41M 5/42 |

FOREIGN PATENT DOCUMENTS

| | | |
|---|---|---|
| JP | 2005-138558 | 6/2005 |
| JP | 4411394 | 2/2010 |
| JP | 2012-76312 | 4/2012 |
| JP | 2012-192731 | 10/2012 |
| JP | 2014-188911 | 10/2014 |
| WO | WO 2017/057722 A1 | 4/2017 |

* cited by examiner

FIG.3

| REFERENCE NUMERAL | NAME | THICKNESS [μm] | THERMAL CONDUCTIVITY RATIO [W/m/K] |
|---|---|---|---|
| 11 | BASE MATERIAL | 100 | 0.01 TO 5.00 |
| 12 | LIGHT ABSORPTION COLOR DEVELOPING LAYER | 1 TO 50 | 0.01 TO 50 |
| 13 | PHOTOTHERMAL CONVERSION LAYER | 0.5 TO 10 | 0.01 TO 50 |
| 14 | BINDER LAYER | 0.5 TO 100 | 0.01 TO 50 |
| 15 | HIGH-TEMPERATURE THERMOSENSITIVE COLOR DEVELOPING LAYER | 1 TO 10 | 0.1 TO 10 |
| 16 | INTERMEDIATE LAYER | 7 TO 100 | 0.01 TO 50 |
| 17 | MEDIUM-TEMPERATURE THERMOSENSITIVE COLOR DEVELOPING LAYER | 1 TO 10 | 0.1 TO 10 |
| 18 | INTERMEDIATE LAYER | 7 TO 100 | 0.01 TO 50 |
| 19 | LOW-TEMPERATURE THERMOSENSITIVE COLOR DEVELOPING LAYER | 1 TO 10 | 0.1 TO 10 |
| 20 | PROTECTION/FUNCTION LAYER | 0.5 TO 10 | 0.01 TO 1 |

FIG.4

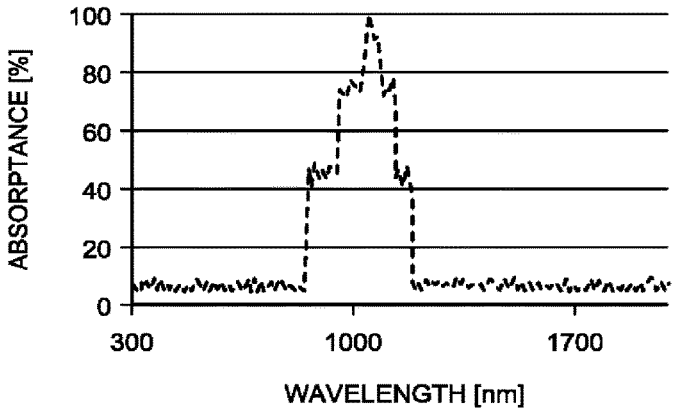

RECORDING MEDIUM AND RECORDING DEVICE

FIELD

Embodiments described herein relate generally to a recording medium and a recording device.

BACKGROUND

Conventionally, there are two major laser full-color recording methods, as follows.

A first method is for applying energy, with a laser, to a medium including three primary color developing layers having different threshold temperatures laminated on one another, to selectively develop color from the three primary color developing layers.

For example, a known method is such that three primary colors are selectively developed by raising or lowering a focus position of laser light through a lens in accordance with an intended layer.

Another known method is such that heat is applied with a laser to a medium including three primary color developing layers having different color temperature thresholds laminated on one another, to develop a color from one of the layers with a lowest threshold temperature, and then eliminate heat sensitivity of the color developing layer with ultraviolet light to change the color developing layer so as not to develop a color by heat. Subsequently, the same process applies to the color developing layer with the second lowest threshold temperature and the color developing layer with the highest threshold temperature for color development, completing full-color recording.

A second method is such that three primary colors are developed for recording from three primary color layers having absorption characteristics at different wavelengths, using lasers having three different wavelengths from one another.

For example, a known method is to complete full-color recording by using a multilayer element that includes at least one layer containing laser sensitive material, and absorbing laser light to develop a color or remove a color for recording each color.

However, the first method requires a certain length of time for transferring heat to a low-temperature color developing layer, which may elongate a total printing time.

The second method requires lasers having three different wavelengths, which may lead to increase the size and cost of a device.

It is thus preferable to provide a recording medium and a recording device with a simple structure that can quickly record a full-color image, and achieve cost reduction.

BRIEF DESCRIPTION OF THE DRAWINGS

FIG. 3 is an explanatory diagram of a thermal conductivity ratio and a thickness of the recording medium in the first embodiment;

FIG. 4 is an explanatory diagram of an example of a light absorption characteristic of a photothermal conversion layer;

DETAILED DESCRIPTION

According to one embodiment, in general, a recording medium includes a base material, a first color developing layer that is laminated on the base material, and absorbs light having a given wavelength to develop a color; a photothermal conversion layer that is laminated closer to an incident side of the light than the first color developing layer, transmits visible light, and absorbs the light for photothermal conversion; and a second color developing layer that is laminated closer to the incident side of the light than the first color developing layer, transmits visible light and the light, and develops a color by heat converted by the photothermal conversion layer.

The following will describe exemplary embodiments in detail with reference to the drawings.

First Embodiment

First, a recording medium according to a first embodiment is described.

Figure 1:
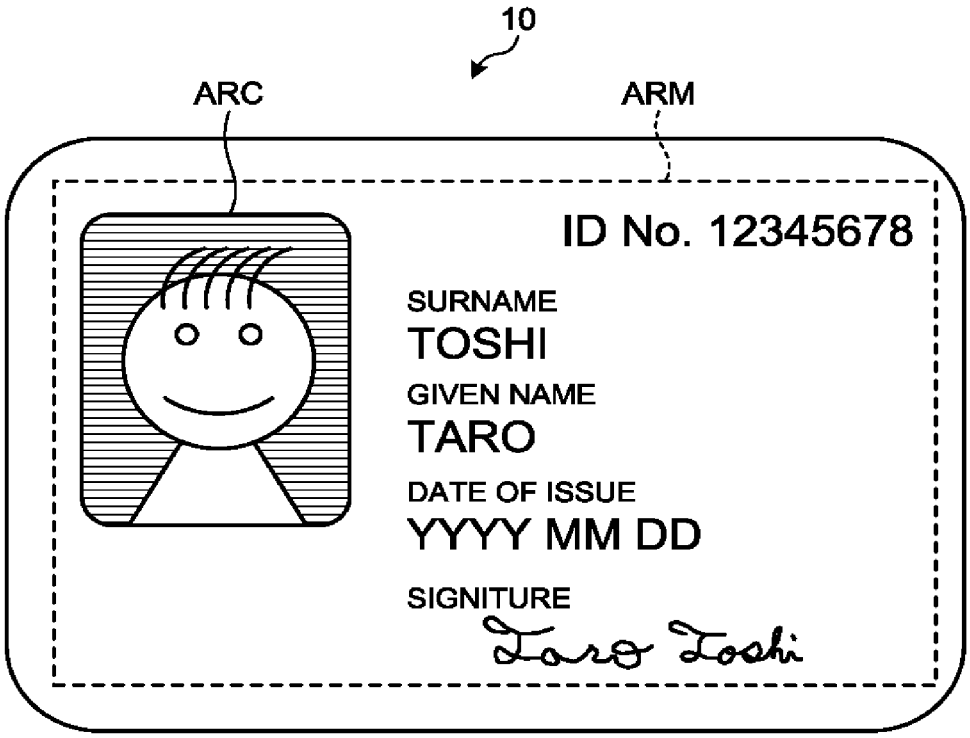
FIG. 1 is a front view of exterior of a recording medium such as anti-forgery and alteration medium according to a first embodiment while information is recorded.

FIG. 1 is a front view of exterior of a recording medium such an anti-forgery and alteration medium according to the first embodiment while information is recorded.

A recording medium 10 on which information is recorded includes a full-color image region ARC on which a full-color image such as an identity photograph is recorded, and a monochrome image region ARM adjacent to the full-color image region ARC and includes specific information such as ID information, a name, and a date of issue in monochrome.

In FIG. 1, the recording medium 10 includes a region in addition to the full-color image region ARC and the monochrome image region ARM, but the entire region excluding the full-color image region ARC may be set to the monochrome image region ARM.

In FIG. 1, the full-color image region ARC and the monochrome image region ARM are adjacent to each other, but the full-color image region ARC and the monochrome image region ARM may be separated from each other. Alternatively, the number of one or both of full-color image regions ARC and monochrome image regions ARM may be plural.

Figure 2:
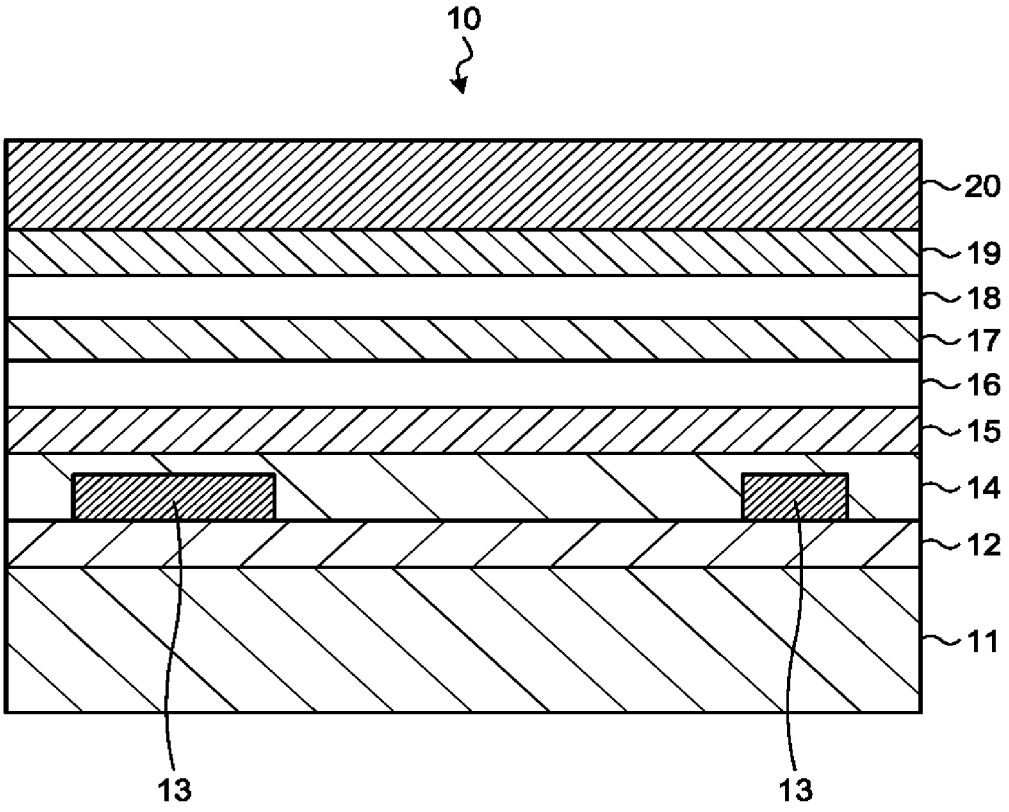
FIG. 2 is a cross-sectional view of a configuration example of the recording medium in the first embodiment.

FIG. 2 is a cross-sectional view of a configuration example of the recording medium in the first embodiment.

FIG. 3 is an explanatory diagram of a thermal conductivity ratio and a thickness of the recording medium in the first embodiment.

As illustrated in FIG. 2, the recording medium 10 includes, on a base material 11, a light absorption color developing layer 12 serving as a first color developing layer, a photothermal conversion layer 13, a binder layer 14, a high-temperature thermosensitive color developing layer 15 serving as a second color developing layer, an intermediate layer 16, a medium-temperature thermosensitive color developing layer 17 serving as the second color developing layer, an intermediate layer 18, a low-temperature thermosensitive color developing layer 19 serving as a second color developing layer, and a protection/function layer 20 in this order.

Each of the high-temperature thermosensitive color developing layer 15, the medium-temperature thermosensitive color developing layer 17, and the low-temperature thermosensitive color developing layer 19 functions as a thermosensitive recording layer on which an image is recorded.

Each of the intermediate layer 16 and the intermediate layer 18 functions as a heat insulating layer for adjusting an amount of heat transfer and suppress heat transfer.

The base material 11 holds the light absorption color developing layer 12, the photothermal conversion layer 13, binder layer 14, the high-temperature thermosensitive color developing layer 15, the intermediate layer 16, the medium-temperature thermosensitive color developing layer 17, the intermediate layer 18, the low-temperature thermosensitive color developing layer 19, and the protection/function layer 20.

The thickness of the base material 11 is, for example, set to 100 μm, and the thermal conductivity ratio thereof is set to 0.01 to 5.00 W/m/K herein.

The light absorption color developing layer 12 contains pigment particles that absorb laser light as light and are carbonized, to irreversibly develop a color.

The thickness of the light absorption color developing layer 12 is, for example, set to 1 to 50 μm, and the thermal conductivity ratio thereof is set to 0.01 to 50 W/m/K herein.

The photothermal conversion layer 13 functions to absorb light (laser light) having a given wavelength, and performs photothermal conversion to generate and transfer heat for causing at least one of the high-temperature thermosensitive color developing layer 15, the medium-temperature thermosensitive color developing layer 17, and the low-temperature thermosensitive color developing layer 19 to develop a color.

The thickness of the photothermal conversion layer 15 is, for example, set to 0.5 to 30 μm, and the thermal conductivity ratio thereof is set to 0.01 to 1 W/m/K herein.

The binder layer 14 functions to hold the light absorption color developing layer 12, the photothermal conversion layer 13, and the high-temperature thermosensitive color developing layer 15 at given positions while binding the light absorption color developing layer 12 and the high-temperature thermosensitive color developing layer 15.

Herein, the thickness of the binder layer 14 is, for example, set to 0.5 to 100 μm, and the thermal conductivity ratio thereof is set to 0.01 to 50 W/m/K.

The high-temperature thermosensitive color developing layer 15 is a layer containing a temperature indicating material as a thermosensitive material that develops a color when the temperature thereof becomes equal to or higher than a first threshold temperature T1.

The thickness of the high-temperature thermosensitive color developing layer 15 is, for example, set to 0.5 to 30 μm, and the thermal conductivity ratio thereof is set to 0.01 to 1 W/m/K.

The intermediate layer 16 functions to provide a thermal barrier at the time when the high-temperature thermosensitive color developing layer 15 develops a color, and suppresses heat transfer from the high-temperature thermosensitive color developing layer 15 to the medium-temperature thermosensitive color developing layer and the low-temperature thermosensitive color developing layer.

Herein, the thickness of the intermediate layer 16 is, for example, set to 7 to 100 μm, and the thermal conductivity ratio thereof is set to 0.01 to 50 W/m/K.

The medium-temperature thermosensitive color developing layer 17 contains a temperature indicating material as a thermosensitive material that develops a color when the temperature thereof becomes equal to or higher than a second threshold temperature T2 (<T1).

Herein, the thickness of the photothermal conversion layer 17 is, for example, set to 1 to 10 μm, and the thermal conductivity ratio thereof is set to 0.1 to 10 W/m/K.

The intermediate layer 1 functions to provide a thermal barrier at the time when the medium-temperature thermosensitive color developing layer 17 develops a color, and suppresses heat transfer from the medium-temperature thermosensitive color developing layer 17 to the low-temperature thermosensitive color developing layer.

Herein, the thickness of the intermediate layer 18 is, for example, set to 7 to 100 μm, and the thermal conductivity ratio thereof is set to 0.01 to 50 W/m/K.

The low-temperature thermosensitive color developing layer 19 contains a temperature indicating material as a thermosensitive material that develops a color when the temperature thereof becomes equal to or higher than a second threshold temperature T3 (<T2<T1).

The thickness of the low-temperature thermosensitive color developing layer 19 is, for example, set to 1 to 10 μm, and the thermal conductivity ratio thereof is set to 0.1 to 10 W/m/K.

The protection/function layer 20 protects the light absorption color developing layer 12, the photothermal conversion layer 13, the binder layer 14, the high-temperature thermosensitive color developing layer 15, the intermediate layer 16, the medium-temperature thermosensitive color developing layer 17, the intermediate layer 18, and the low-temperature thermosensitive color developing layer 19.

Additionally, the protection/function layer 20 is for arranging a forgery prevention item such as a hologram, a lenticular lens, a microarray lens, and ultraviolet excitation-type fluorescence ink, for inserting an inner protective item such as a UV cutting layer, or for using both of the functions.

The thickness of the protection/function layer 20 is, for example, set to 0.5 to 10 μm, and the thermal conductivity ratio thereof is set to 0.01 to 1 W/m/K herein.

The following describes a light absorption characteristic of the photothermal conversion layer 13, the binder layer 14, the high-temperature thermosensitive color developing layer 15, the intermediate layer 16, the medium-temperature thermosensitive color developing layer 17, the intermediate layer 18, the low-temperature thermosensitive color developing layer 19, and the protection/function layer 20 in detail.

FIG. 4 is an explanatory diagram of an example of the light absorption characteristic of the photothermal conversion layer.

As illustrated in FIG. 4, the photothermal conversion layer 13 has infrared ray absorption characteristic having an absorption peak at a wavelength λ (for example, λ=1064 nm) of a near infrared ray.

On the other hand, the binder layer 14, the high-temperature thermosensitive color developing layer 15, the intermediate layer 16, the medium-temperature thermosensitive color developing layer 17, the intermediate layer 18, the low-temperature thermosensitive color developing layer 19, and the protection/function layer 20 are formed of a material that transmits light having the wavelength λ of a near infrared ray (near infrared light). Thereby, light having the wavelength λ (near infrared light) absorbable by the light absorption color developing layer 12 or the photothermal conversion layer 13 can reach the light absorption color developing layer 12 or the photothermal conversion layer 13.

Thus, in the full-color image region ARC, infrared light having the wavelength λ (for example, λ=1064 nm), emitted from the protection/function layer 20, transmits through the low-temperature thermosensitive color developing layer 19, the intermediate layer 18, the medium-temperature thermosensitive color developing layer 17, the intermediate layer 16, the high-temperature thermosensitive color developing layer 15, and the binder layer 14 in this order.

The near infrared light having the wavelength λ is then substantially absorbed by the photothermal conversion layer 13 to be subjected to photothermal conversion, and causes the high-temperature thermosensitive color developing layer 15, the medium-temperature thermosensitive color developing layer 17, or the low-temperature thermosensitive color developing layer 19 to develop a color.

In the monochrome image region ARM, the near infrared light having the wavelength λ transmits through the protection/function layer 20, the low-temperature thermosensitive color developing layer 19, the intermediate layer 18, the medium-temperature thermosensitive color developing layer 17, the intermediate layer 16, the high-temperature thermosensitive color developing layer 15, and the binder layer 14 in this order, is substantially absorbed by the light absorption color developing layer 12 to develop a color.

Next, the following describes materials of the respective layers.

First, the following describes the base material 11.

Examples of the base material 11 include a resin that can be processed in a film plate form, the resin such as a polyester resin, polyethylene terephthalate (PET), glycol modified polyester (PET-G), polypropylene (PE), polycarbonate (PC), polyvinyl chloride (PVC), a styrene-butadiene copolymer (SBR), a polyacrylic resin, a polyurethane resin, and a polystyrene resin, which are typically used as a card, paper, and a film material.

Additionally, by adding silica, titanium oxide, calcium carbonate, alumina, and the like to the above resin as a filler, a resin having whiteness, a surface smoothness, and an insulating property can be used as the base material 11.

For example, paper (sheet) and a resin material disclosed in Japanese Patent No. 3889431, Japanese Patent No. 4215817, Japanese Patent No. 4329744, and Japanese Patent No. 4391286 can be used in addition to the resins described above.

Specifically, examples of the base material 11 include polyethylene terephthalate (A-PET, PETG), polycyclohexylene dimethylene terephthalate (PCT), polystyrene (PS), polymethyl methacrylate (PMMA), transparent ABS (MABS), polypropylene (PP), polyethylene (PE), polyvinyl alcohol (PVA), a styrene-butadiene copolymer (SBR), an acrylic resin, an acrylic-modified urethane resin, a styrene/acrylic resin, an ethylene/acrylic resin, an urethane resin, a rosin-modified maleic acid resin, a vinyl chloride/vinyl acetate copolymer, a polyvinyl acetal resin, a polyamide resin, a cellulose-based resin such as hydroxyethyl cellulose, hydroxypropyl cellulose, and cellulose nitrate, other resins such as a polyolefin-based resin, a polyamide resin, a biodegradable resin, and a cellulose-based resin, a paper base material, a metal material, and the like.

The resins and the filler described above are merely examples, and other materials having sufficient workability and functionality can also be used.

In the configuration described above, it is preferable to use a white resin or a transparent resin.

Herein, the term "transparent" refers to light transmittance in a visible light region equal to or higher than 30% in average.

Next, the following describes the photothermal conversion layer 13.

The photothermal conversion layer 13 contains an infrared absorption (light absorption) exothermic material that transmits visible light and absorbs infrared light, and a binder resin. The light absorption exothermic material and the binder resin are mixed, in a solvent, to be applied so that a mass ratio of solid content between the light absorption exothermic material and the binder resin becomes the infrared absorption exothermic material: binder resin=1 to 20:99 to 80.

When the photothermal conversion layer 13 is applied, a film thickness thereof is preferably 1 to 10 μm, and is more preferably 1 to 5 μm.

Examples of the infrared absorption exothermic material contained in the photothermal conversion layer 13 include polymethine-based cyanine pigment, polymethine-based pigment, squarylium-based pigment, porphyrin-based pigment, metal dithiol complex-based pigment, phthalocyanine-based pigment, diimmonium-based pigment, inorganic oxide particles and the like, azo-based pigment, quinone-based pigment such as naphthoquinone-based pigment or anthraquinone-based pigment, cerium oxide, indium-tin oxide, antimony-tin oxide, cesium-tungsten oxide, lanthanum hexaboride, and the like.

Examples of the binder resin contained in the photothermal conversion layer 13 include cellulose esters such as cellulose nitrate, cellulose phosphate, cellulose sulfate, cellulose propionate, cellulose acetate, cellulose propionate, cellulose palmitate, cellulose myristate, cellulose acetate butyrate, and cellulose acetate propionate, and a cellulose-based resin such as a polyester-based resin, hydroxyethyl cellulose, hydroxypropyl cellulose, ethyl cellulose, methyl cellulose, and cellulose acetate.

Example of the binder resin contained in the photothermal conversion layer 13 include a vinyl-based resin such as polyvinyl alcohol, polyvinyl acetate, polyvinyl butyral, polyvinyl acetal, and polyacrylamide, acrylic resins such as polymethyl acrylate and polyacrylic acid, polyolefins such as polyethylene and polypropylene, polyacrylate resins, epoxy resins, phenolic resins, and the like.

Specifically, representative examples of the binder resin include a PET-based resin, PETS, a PVC-based resin, a PVA-based resin, a PC-based resin, a PP-based resin, a PE-based resin, an ABS-based resin, a polyamide-based resin, and vinyl acetate-based resin. Additionally, examples of the photothermal conversion layer 13 include a copolymer based on the above resins, and a resin obtained by adding an additive such as silica, calcium carbonate, titanium oxide, and carbon to the above resins.

The binder layer 14 is typically made of the same resin as the binder resin of the photothermal conversion layer 13.

Next, the following describes the high-temperature thermosensitive color developing layer 15, the medium-temperature thermosensitive color developing layer 17, and the low-temperature thermosensitive color developing layer 19.

Exemplary materials of the high-temperature thermosensitive color developing layer 15, the medium-temperature thermosensitive color developing layer 17, and the low-temperature thermosensitive color developing layer 19 include, as the binder resin, resins having high transparency such as polyvinyl alcohol, polyvinyl acetate, and polyacrylamide. Examples of a color developing material that develops a color at temperature over a certain threshold temperature include a leuco dye, leuco pigment, or a temperature indicating material, and a developer.

Examples of the leuco dye, the leuco pigment, or the temperature indicating material include a color developing dye such as 3,3-bis (1-n-butyl-2-methyl-indole-3-yl) phthalide, 7-(1-butyl-2-methyl-1H-indole-3-yl)-7-(4-diethylamino-2-methyl-phenyl)-7H-furo[3,4-b]pyridine-5-one, 1-(2,4-dichloro-phenylcarbamoyl)-3,3-dimethyl-2-oxo-1-phenoxy-butyl]-(4-diethylaminophenyl)-isobutyl carbamate, 3,3-bis(p-dimethylaminophenyl)phthalide, 3,3-bis(p-dimethylaminophenyl)-6-dimethylaminophthalide (another name: crystal violet lactone=CVL), 3,3-bis(p-dimethylaminophenyl)-6-aminophthalide, 3,3-bis(p-dimethylaminophenyl)-6-nitrophthalide, 3,3-bis3-dimethylamino-7-methylfluoran, 3-diethylamino-7-chlorofluoran, 3-diethylamino-6-chloro-7-methylfluoran, 3-diethylamino-7-anilinofluoran, 3-diethylamino-6-methyl-7-anilinofluoran, 2-(2-fluorophenylamino)-6-diethylaminofluoran, 2-(2-fluorophenylamino)-6-di-n-butylaminofluoran, 3-piperidino-6-methyl-7-anilinofluoran, 3-(N-ethyl-p-toluidino)-7-(N-methylanilino)fluoran, 3-(N-ethyl-p-toluidino)-6-methyl-7-anilinofluoran, 3-N-ethyl-N-isoamylamino-6-methyl-7-anilinofluoran, 3-N-methyl-N-cyclohexylamino-6-methyl-7-anilinofluoran, 3-N,N-diethylamino-7-o-chloroanilinofluoran, rhodamine B lactam, 3-methylspirodinaphtopyran, 3-ethyl spirodinaphtopyran, and 3-benzylspironaphtopyran.

The developer can be any of acidic substances to be used as an electron acceptor of a thermosensitive recording medium.

Examples of the developer include an inorganic substance such as activated clay and acid clay, an inorganic acid, an aromatic carboxylic acid, an anhydride or metallic salt thereof, an organic sulfonic acid, other organic acids, and an organic developer such as a phenolic compound. The phenolic compound is preferable.

Examples of the developer specifically include a phenolic compound such as bis3-allyl-4-hydroxyphenylsulfone, polyhydroxystyrene, a zinc salt of 3,5-di-t-butylsalicylate, a zinc salt of 3-octyl-5-methylsalicylate, phenol, 4-phenylphenol, 4-hydroxyacetophenone, 2,2'-dihydroxydiphenyl, 2,2'-methylenebis (4-chlorophenol), 2,2'-methylenebis(4-methyl-6-t-butylphenol), 4,4'-isopropylidenediphenol (another name: bisphenol A), 4,4'-isopropylidenebis(2-chlorophenol), 4,4'-isopropylidenebis(2-methylphenol), 4,4'-ethylenebis(2-methylphenol), 4,4'-thiobis(6-t-butyl-3-methylphenol), 1,1-bis(4-hydroxyphenyl)-cyclohexane, 2,2'-bis(4-hydroxyphenyl)-n-heptane, 4,4'-cyclohexylidenebis(2-isopropylphenol), and 4,4'-sulfonyldiphenol, a salt of the phenolic compound, anilide salicylate, a novolak-type phenolic resin, and benzyl p-hydroxybenzoate.

Example of the material of the intermediate layer 16 and the intermediate layer 16 include polypropylene (FP), polyvinyl alcohol (PVA), a styrene-butadiene copolymer (SBR), polystyrene, polyacrylic, and the like.

The protection/function layer 20 may be provided as needed. Specific functions of the protection/function layer 20 may include insertion of a forgery prevention item such as a hologram, a lenticular lens, a microarray lens, and ultraviolet excitation-type fluorescence ink, insertion of an inner protective item such as a UV cutting layer, or both of the functions. In this case, the protection/function layer 20 is preferably transparent, and is more preferably colorless and transparent for the purpose of visually checking recording or monochrome recording under the protection/function layer 20 after the recording.

Next, the following describes a laser recording device in the first embodiment.

Figure 5:
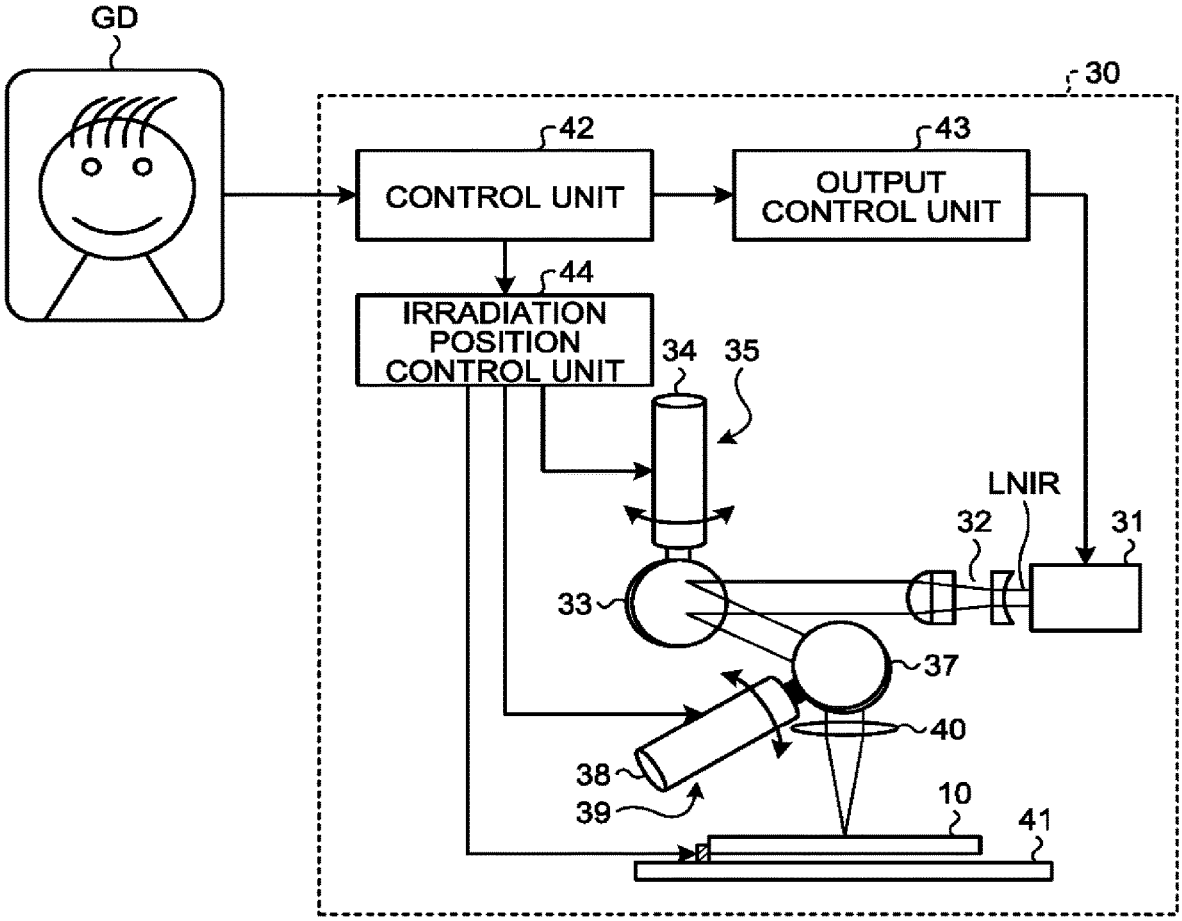
FIG. 5 is an overview block diagram of a laser recording device in the first embodiment.

FIG. 5 is an overview block diagram of the laser recording device in the first embodiment.

The laser recording device 30 in the first embodiment includes a laser oscillator 31 that outputs near infrared laser light LNIR with wavelength λ, a beam expander 32 that expands a beam diameter of the near infrared laser light LNIR, and a first direction scanning unit 35 including a first motor 34 that drives a first direction scanning mirror 33 for reflecting the near infrared laser light LNIR, and drives the first direction scanning mirror 33 for performing scanning in a first direction with the near infrared laser light LNIR.

The laser recording device 30 in the first embodiment also includes a second direction scanning unit 39 including a second motor 38 that drives a second direction scanning mirror 36 for reflecting the near infrared laser light LNIR, and drives a second direction scanning mirror 37 for performing scanning in a second direction orthogonal to the first direction with the near infrared laser light LNIR, a condensing lens (Fθ lens) 40 that concentrates, to the recording medium 10, the near infrared laser light LNIR introduced via the first direction scanning unit 35 and the second direction scanning unit 39, and a stage 41 that conveys the recording medium 10 to be held at a given position.

The laser recording device 30 in the first embodiment further includes a control unit 42 that calculates an irradiation position and irradiation intensity of far infrared laser light LFIR and controls the entire laser recording device 30 based on input image data GD that has been input, an output control unit 43 that controls a laser output from the laser oscillator 31 based on a calculation result obtained by the control unit 42, and an irradiation position control unit 44 that controls the first motor 34 and the second motor 38 based on the calculation result obtained by the control unit 42 and controls an irradiation position of the near infrared laser light LNIR with respect to the recording medium 10.

In the configuration described above, the laser oscillator 31 can be a semiconductor laser, a fiber laser, a YAG laser, and a $YVO_4$ laser serving as a laser for a near infrared region.

Next, the following describes recording processing performed by the laser recording device 30 for the recording medium 10.

Figure 6:
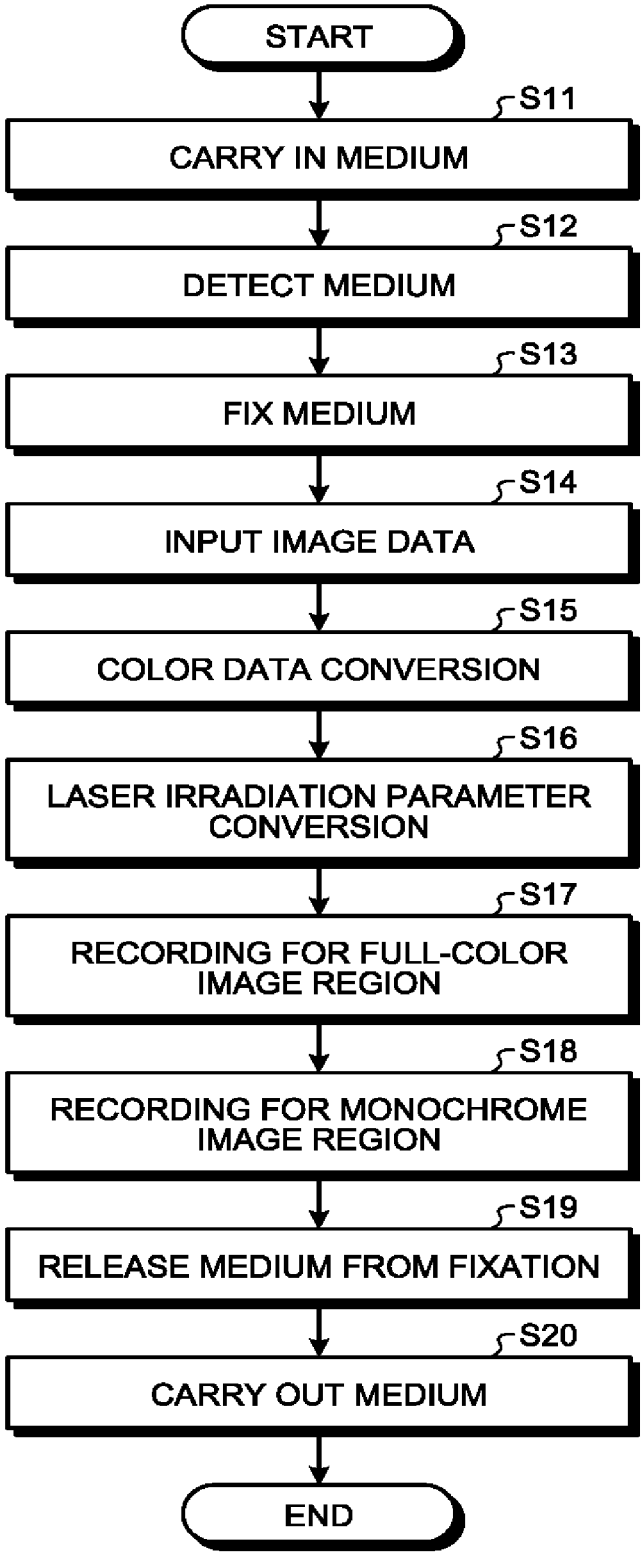
FIG. 6 is a flowchart of processing performed by the laser recording device.

FIG. 6 is a flowchart of processing performed by the laser recording device.

In the following, the light absorption color developing layer 12 is set to a black (K) color developing layer, the high-temperature thermosensitive color developing layer 15 is set to a yellow (Y) color developing layer, the medium-temperature thermosensitive color developing layer 17 is set to a magenta (M) color developing layer, and the low-temperature thermosensitive color developing layer 19 is set to a cyan (C) color developing layer.

First, the control unit 42 of the laser recording device 30 carries the recording medium 10 into a recording position via a conveying device (not illustrated) (Step S11).

Subsequently, the control unit 42 of the laser recording device 30 detects the recording medium 10 that has been carried in with a sensor (not illustrated) (Step S12), and fixes the recording medium 10 at a given carry-in position with a fixing device (not illustrated) (Step S13).

Subsequently, when the input image data GD as RGB data is input (Step S14), the control unit 42 of the laser recording device 30 analyzes the input image data GD, and converts the input image data GD into color data (CMYK data) for each pixel (Step S15).

Subsequently, the control unit 42 converts the color data into a laser irradiation parameter value in accordance with a combination of layers to develop a color based on the color data for each pixel (Step S16).

Specifically, the laser irradiation parameter value includes a set power value, a set scanning-speed value, a set pulse-width value, a set irradiation-repetition-number value, or a set scanning-pitch value.

Subsequently, the control unit 42 controls the output control unit 43 and the irradiation position control unit 44 to record an image on the full-color image region ARC to cause the high-temperature thermosensitive color developing layer 15, the medium-temperature thermosensitive color developing layer 17, and the low-temperature thermosensitive color developing layer 15 to develop a color, using the near infrared laser light LNIR based on the laser irradiation parameter value set at Step S13 (Step S17).

The following describes color development control in the full-color image region ARC.

In the full-color image region ARC, the laser recording device 30 performs color development using the high-temperature thermosensitive color developing layer 15, the medium-temperature thermosensitive color developing layer 17, and the low-temperature thermosensitive color developing layer 19.

As described above, the high-temperature thermosensitive color developing layer 15 develops a color when the temperature thereof becomes equal to or higher than the first threshold temperature T1, the medium-temperature thermosensitive color developing layer 17 develops a color when the temperature thereof becomes equal to or higher than the second threshold temperature T2 (<T1), and the low-temperature thermosensitive color developing layer 19 develops a color when the temperature thereof becomes equal to or higher than the third threshold temperature T3 (<T2<T1).

More specifically, for example, the first threshold temperature T1 of the high-temperature thermosensitive color developing layer 15 is in the range of 150 to 270° C., the second threshold temperature T2 of the medium-temperature thermosensitive color developing layer 17 is in the range of 100 to 200° C., and the third threshold temperature T3 of the low-temperature thermosensitive color developing layer 19 is in the range of 60 to 140° C. The respective thermosensitive color developing layers are set to satisfy the above ranges.

First, the following describes color development control over the high-temperature thermosensitive color developing layer 15 alone.

Figure 7:
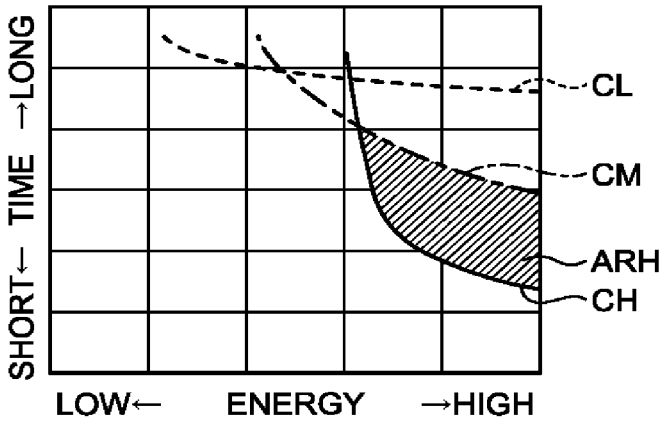
FIG. 7 is a diagram for explaining a relation between energy and an irradiation time of laser light in the case of causing a high-temperature thermosensitive developing layer alone to develop a color.

FIG. 7 is a diagram for explaining a relation between energy and an irradiation time of laser light in the case of causing the high-temperature thermosensitive color developing layer to develop a color.

As illustrated in FIG. 7, the high-temperature thermosensitive color developing layer 15 develops a color in an upper right region of a corresponding color development curve CH (a color development region of the high-temperature thermosensitive color developing layer 15).

The medium-temperature thermosensitive color developing layer 17 develops a color in an upper right region of a corresponding color development curve CM (a color development region of the medium-temperature thermosensitive color developing layer 17).

The low-temperature thermosensitive color developing layer 19 develops a color in an upper right region of a corresponding color development curve CL (a color development region of the low-temperature thermosensitive color developing layer 19).

Thus, to cause the high-temperature thermosensitive color developing layer 15 to develop a color, the energy and the irradiation time of the laser light may be set to fall in the color development region of the high-temperature thermosensitive color developing layer 15, a non-color development region of the medium-temperature thermosensitive color developing layer 17, and a non-color development region of the low-temperature thermosensitive color developing layer 19, as a region ARH indicated by hatching in FIG. 7.

The following describes color development control over the high-temperature thermosensitive color developing layer 15 in more detail.

Figure 8:
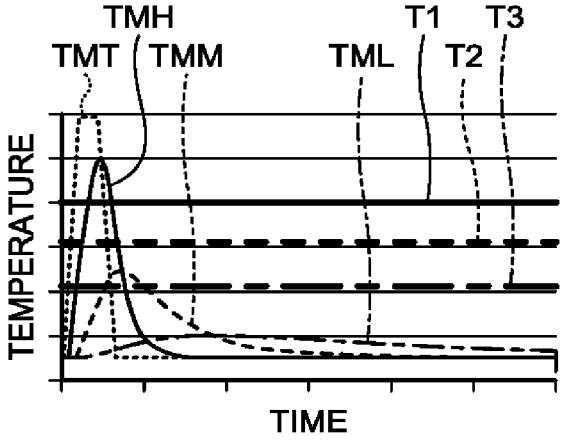
FIG. 8 is an explanatory diagram of a temperature for controlling color development of the high-temperature thermosensitive color developing layer.

FIG. 8 is an explanatory diagram of a temperature for controlling color development of the high-temperature thermosensitive color developing layer.

To cause the high-temperature thermosensitive color developing layer 15 to develop a color, the photothermal conversion layer 13 generates and transfers heat necessary for color development to the high-temperature thermosensitive color developing layer 15.

To implement that process, as illustrated in FIG. 8, the near infrared laser light LNIR may be emitted after setting the laser irradiation parameter value so that a temperature TMH of the high-temperature thermosensitive color developing layer 15 exceeds the first threshold temperature T1, a temperature TMM of the medium-temperature thermosensitive color developing layer 17 does not exceed the second thresh temperature T2, and a temperature TML of the low-temperature thermosensitive color developing layer 19 does not exceed the third threshold temperature T3 to control a temperature TMT of the photothermal conversion layer 13.

The near infrared laser light LNIR then reaches the photothermal conversion layer 13 via the protection/function layer 20, the low-temperature thermosensitive color developing layer 19, the intermediate layer 18, the medium-temperature thermosensitive color developing layer 17, the intermediate layer 16, the high-temperature thermosensitive color developing layer 15, and the binder layer 14.

In this case, as illustrated in FIG. 8, the laser irradiation parameter value is set for the near infrared laser light LNIR to be emitted to the photothermal conversion layer 13 so that a heating amount steeply increases and a heat generation time is shortened.

Thus, the photothermal conversion layer 13 absorbs the near infrared laser light LNIR, performs photothermal conversion, and steeply generates heat. The temperature TMT of the photothermal conversion layer 13 varies as illustrated in FIG. 8.

Thus, the temperature of the high-temperature thermosensitive color developing layer 15 closer to the photothermal conversion layer 13 steeply increases, and exceeds the first threshold temperature T1. The high-temperature thermosensitive color developing layer 15 then develops a color of yellow (Y).

On the other hand, the heat is conducted from the photothermal conversion layer 13 to the medium-temperature thermosensitive color developing layer 17 via the binder layer 14, the high-temperature thermosensitive color developing layer 15, and the intermediate layer 16, and furthermore, the heat is conducted to the low-temperature thermosensitive color developing layer 19 via the intermediate layer 18.

However, as illustrated in FIG. 8, a time during which the heat is conducted is short, and an amount of heat (thermal energy) transferred to the medium-temperature thermosensitive color developing layer 17 and the low-temperature thermosensitive color developing layer 19 is small, so that an increase in the temperature TMM of the medium-temperature thermosensitive color developing layer 17 and the temperature TML of the low-temperature thermosensitive color developing layer 19 is small.

Thus, as illustrated in FIG. 8, the temperature TMM of the medium-temperature thermosensitive color developing layer 17 does not exceed the second threshold temperature 12, and the medium-temperature thermosensitive color developing layer 17 does not develop a color.

Similarly, as illustrated in FIG. 8, the temperature TML of the low-temperature thermosensitive color developing layer 19 does not exceed the third threshold temperature T3, and the low-temperature thermosensitive color developing layer 17 does not develop a color.

The near infrared laser light LNIR is absorbed by the photothermal conversion layer 13, and does not reach the light absorption color developing layer 12, so that the light absorption color developing layer 12 also does not develop a color.

Next, the following describes color development control over the medium-temperature thermosensitive color developing layer 17 alone.

Figure 9:
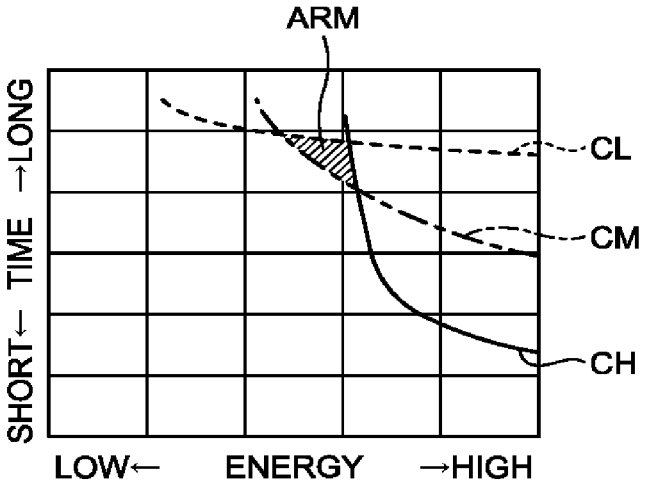
FIG. 9 is a diagram for explaining a relation between energy and an irradiation time of laser light in the case of causing a medium-temperature thermosensitive color developing layer alone to develop a color.

FIG. 9 is a diagram for explaining a relation between the energy and the irradiation time of the laser light in the case of causing the medium-temperature thermosensitive color developing layer to develop a color.

As with the high-temperature thermosensitive color developing layer 15, to cause the medium-temperature thermosensitive color developing layer 17 to develop a color, the energy and the irradiation time of the laser light may be set to fail in a color development region of the medium-temperature thermosensitive color developing layer 17, a non-color development region of the high-temperature thermosensitive color developing layer 15, and a non-color development region of the low-temperature thermosensitive color developing layer 19, as a region ARM indicated by hatching in FIG. 9.

The following describes color development control over the medium-temperature thermosensitive color developing layer 17 in more detail.

Figure 10:
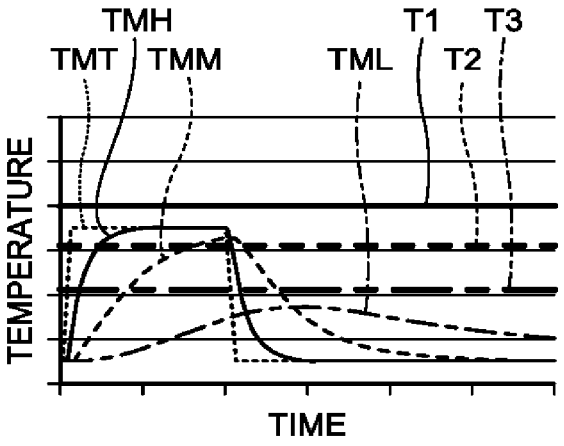
FIG. 10 is an explanatory diagram of a temperature for controlling color development of the medium-temperature thermosensitive color developing layer.

FIG. 10 is an explanatory diagram of a temperature for controlling color development of the medium-temperature thermosensitive color developing layer.

To cause the medium-temperature thermosensitive color developing layer 17 to develop a color, the photothermal conversion layer 13 generates and transfers heat required for color development to the medium-temperature thermosensitive color developing layer 17 via the high-temperature thermosensitive color developing layer 15 and the intermediate layer 16 without color development of the high-temperature thermosensitive color developing layer 15.

To implement this process, as illustrated in FIG. 10, the near infrared laser light LNIR may be emitted after setting the laser irradiation parameter value so that the temperature of the medium-temperature thermosensitive color developing layer 17 exceeds the second threshold temperature T2, the temperature of the high-temperature thermosensitive color developing layer 15 does not exceed the first threshold temperature T1, and the temperature of the low-temperature thermosensitive color developing layer 19 does not exceed the third threshold temperature T3 to control the temperature TMT of the photothermal conversion layer 13.

The near infrared laser light LNIR then reaches the photothermal conversion layer 13 via the protection/function layer 20, the low-temperature thermosensitive color developing layer 19, the intermediate layer 18, the medium-temperature thermosensitive color developing layer 17, the intermediate layer 16, the high-temperature thermosensitive color developing layer 15, and the binder layer 14.

In this case, the laser irradiation parameter value of the near infrared laser light LNIR to be emitted to the photothermal conversion layer 13 is set such that the heating amount increases more gradually and the heat generation time is prolonged, as compared with the high-temperature thermosensitive color developing layer 15 developing a color.

Thus, the photothermal conversion layer 13 absorbs the near infrared laser light LNIR, performs photothermal conversion, and gradually generates heat. The temperature TMT of the photothermal conversion layer 13 varies as illustrated in FIG. 10.

Thus, the temperature of the high-temperature thermosensitive color developing layer 15 closer to the photothermal conversion layer 13 increases, but does not exceed the first threshold temperature T1, so that the high-temperature thermosensitive color developing layer 15 does not develop the color of yellow (Y).

On the other hand, the heat is conducted from the photothermal conversion layer 13 to the medium-temperature thermosensitive color developing layer 17 via the binder layer 14, the high-temperature thermosensitive color developing layer 15, and the intermediate layer 16, and furthermore, the heat is conducted to the low-temperature thermosensitive color developing layer 19 via the intermediate layer 18.

In this case, as illustrated in FIG. 10, the time during which the heat is conducted is longer and the temperature is lower than those in the case of causing the high-temperature thermosensitive color developing layer 15 to develop a color. However, the second threshold temperature T2 at which the medium-temperature thermosensitive color developing layer 17 develops a color is lower than the first threshold temperature T1, so that required energy sufficient for color development is transferred to the medium-temperature thermosensitive color developing layer 17.

Thus, the temperature of the medium-temperature thermosensitive color developing layer 17 exceeds the second threshold temperature T2, and the medium-temperature thermosensitive color developing layer 17 develops a color of magenta (M).

In this case, the amount of heat (thermal energy) to be transferred is small because the low-temperature thermosensitive color developing layer 19 is at a position distant from the photothermal conversion layer 13, so that an increase in the temperature of the low-temperature thermosensitive color developing layer 19 is small.

Thus, the temperature of the low-temperature thermosensitive color developing layer 19 does not exceed the third threshold temperature T3, and the low-temperature thermosensitive color developing layer 17 does not develop a color.

The near infrared laser light LNIR is absorbed by the photothermal conversion layer 13, and does not reach the light absorption color developing layer 12, so that the light absorption color developing layer 12 also does not develop a color.

Next, the following describes color development control over the low-temperature thermosensitive color developing layer 19.

Figure 11:
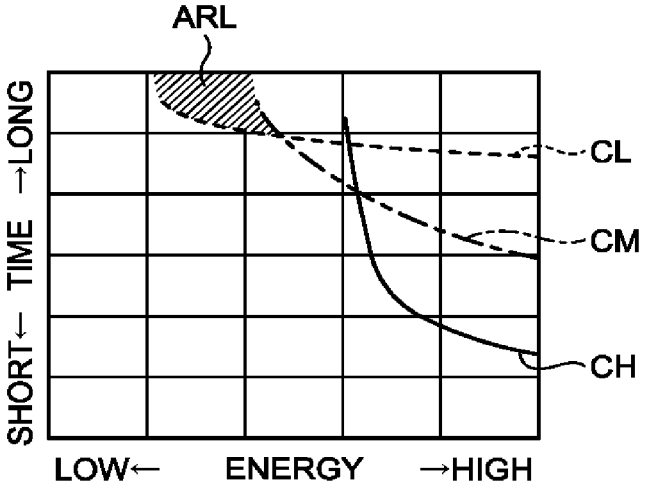
FIG. 11 is a diagram for explaining a relation between energy and an irradiation time of laser light in the case of causing a low-temperature thermosensitive color developing layer alone to develop a color.

FIG. 11 is a diagram for explaining a relation between the energy and the irradiation time of the laser light in the case of causing the low-temperature thermosensitive color developing layer to develop a color.

Similarly to the high-temperature thermosensitive color developing layer 15, in the case of causing the low-temperature thermosensitive color developing layer 19 to develop a color, the energy and the irradiation time of the laser light may be set to fall in a color development region of the low-temperature thermosensitive color developing layer 19, the non-color development region of the high-temperature thermosensitive color developing layer 15, and the non-color development region of the medium-temperature thermosensitive color developing layer 17, like a region ARL indicated by hatching in FIG. 11.

The following describes color development control for the low-temperature thermosensitive color developing layer 19 in more detail.

Figure 12:
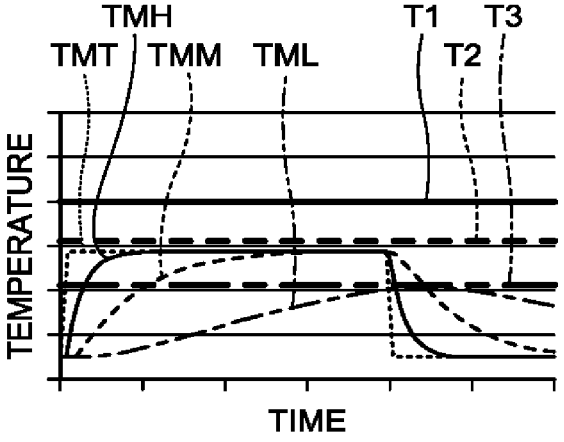
FIG. 12 is an explanatory diagram of a temperature for controlling color development of the low-temperature thermosensitive color developing layer.

FIG. 12 is an explanatory diagram of a temperature for controlling color development of the low-temperature thermosensitive color developing layer.

In this case, the laser irradiation parameter value is set for the near infrared laser light LNIR to be emitted to the photothermal conversion layer 13 so that the heating amount increases more gradually and the heat generation time is further prolonged, as compared with causing the medium-temperature thermosensitive color developing layer 17 to develop a color.

Thus, the photothermal conversion layer 13 absorbs the near infrared laser light LNIR, performs photothermal conversion, and generates heat more gradually. Thus, the temperature of the high-temperature thermosensitive color developing layer 15 closer to the photothermal conversion layer 13 does not exceed the first threshold temperature T1, and the high-temperature thermosensitive color developing layer 15 does not develop the color of yellow (Y).

The heat is conducted from the photothermal conversion layer 13 to the medium-temperature thermosensitive color developing layer 17 via the binder layer 14, the high-temperature thermosensitive color developing layer 15, and the intermediate layer 16.

In this case, as illustrated in FIG. 12, the time during which the heat is conducted is longer than that when the medium-temperature thermosensitive color developing layer 17 develops a color, but the temperature is further lower than that case. Thus, the temperature of the medium-temperature thermosensitive color developing layer 17 does not exceed the second threshold temperature T2, and the high-temperature thermosensitive color developing layer 15 does not develop the color of magenta (M).

The heat is further conducted from the photothermal conversion layer 13 to the low-temperature thermosensitive color developing layer 19 via the binder layer 14, the high-temperature thermosensitive color developing layer 15, the intermediate layer 16, the medium-temperature thermosensitive color developing layer 17, and the intermediate layer 18.

In this case, the low-temperature thermosensitive color developing layer 19 is at a position distant from the photothermal conversion layer 13. However, as illustrated in FIG. 12, the time during which the heat is conducted is longer and the temperature is lower than those in the case of causing the medium-temperature thermosensitive color developing layer 17 to develop a color, but the third threshold temperature T3 at which the low-temperature thermosensitive color developing layer 19 develops a color is further lower, so that required energy sufficient for color development is transferred to the low-temperature thermosensitive color developing layer 19.

Thus, the temperature of the low-temperature thermosensitive color developing layer 19 exceeds the third threshold temperature T3, and the low-temperature thermosensitive color developing layer 19 develops a color of cyan (C) in the full-color image region ARC.

The above has described the examples of causing each of the high-temperature thermosensitive color developing layer 15, medium-temperature thermosensitive color developing layer 17, and low-temperature thermosensitive color developing layer 19 to develop a color. Alternatively, two or three colors can be developed at the same time.

The following describes an example of developing a plurality of colors.

Figure 13:
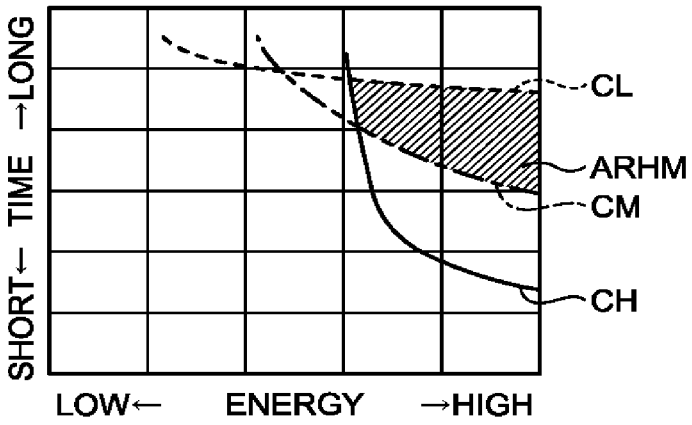
FIG. 13 is a diagram for explaining a relation between energy and an irradiation time of laser light in the case of causing the high-temperature thermosensitive color developing layer and the medium-temperature thermosensitive color developing layer to develop a color in parallel.

FIG. 13 is a diagram for explaining a relation between the energy and the irradiation time of the laser light in the case of causing the high-temperature thermosensitive color developing layer and the medium-temperature thermosensitive color developing layer to develop a color in parallel.

To cause the high-temperature thermosensitive color developing layer 15 and the medium-temperature thermosensitive color developing layer 17 to develop a color in parallel, the energy and the irradiation time of the laser light may be set in a region of the color development region of the high-temperature thermosensitive color developing layer 15, the color development region of the medium-temperature thermosensitive color developing layer 17, and the non-color development region of the low-temperature thermosensitive color developing layer 19, like a region ARHM indicated by hatching in FIG. 13.

By performing such control, the color of yellow (Y) corresponding to the high-temperature thermosensitive color developing layer 15 is developed, and the color of magenta (M) corresponding to the medium-temperature thermosensitive color developing layer 17 is developed. As a result, a color of red is developed in the full-color image region ARC.

Figure 14:
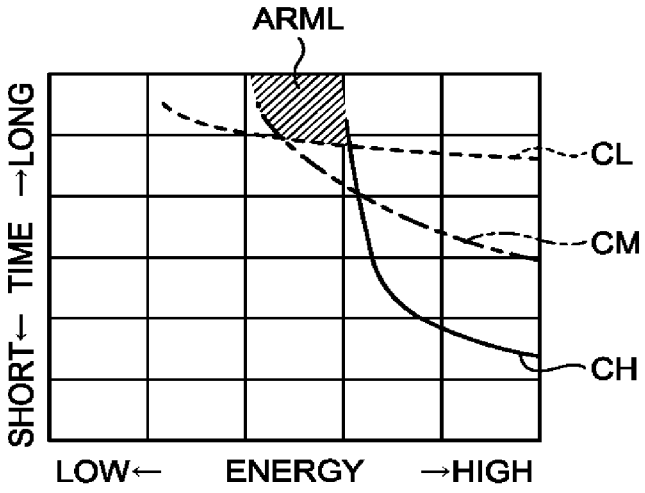
FIG. 14 is a diagram for explaining a relation between energy and an irradiation time of laser light in the case of causing the medium-temperature thermosensitive color developing layer and the low-temperature thermosensitive color developing layer to develop a color in parallel.

FIG. 14 is a diagram for explaining a relation between the energy and the irradiation time of the laser light in the case of causing the medium-temperature thermosensitive color developing layer and the low-temperature thermosensitive color developing layer to develop a color in parallel.

In the case of causing the medium-temperature thermosensitive color developing layer 17 and the low-temperature thermosensitive color developing layer 19 to develop a color in parallel, the energy and the irradiation time of the laser light may be set to fall in the color development region of the medium-temperature thermosensitive color developing layer 17, the color development region of the low-temperature thermosensitive color developing layer 19, and the non-color development region of the high-temperature thermosensitive color developing layer 15, like a region ARML indicated by hatching in FIG. 14.

By controlling the energy and the irradiation time of the laser light in this way, the color of magenta (M) corresponding to the medium-temperature thermosensitive color developing layer 17 is developed, and the color of cyan (C) corresponding to the low-temperature thermosensitive color developing layer 19 is developed. As a result, a color of blue is developed in the full-color image region ARC.

Figure 15:
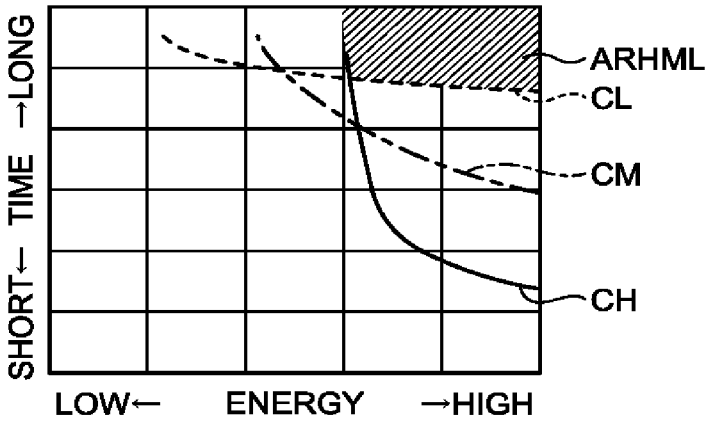
FIG. 15 is a diagram for explaining a relation between energy and an irradiation time of laser light in the case of causing the high-temperature thermosensitive color developing layer, the medium-temperature thermosensitive color developing layer, and the low-temperature thermosensitive color developing layer to develop a color in parallel.

FIG. 15 is a diagram for explaining a relation between the energy and the irradiation time of the laser light in the case of causing the high-temperature thermosensitive color developing layer, the medium-temperature thermosensitive color developing layer, and the low-temperature thermosensitive color developing layer to develop a color in parallel.

To cause the high-temperature thermosensitive color developing layer 15, the medium-temperature thermosensitive color developing layer 17, and the low-temperature thermosensitive color developing layer 19 to develop a color in parallel, the energy and the irradiation time of the laser light may be set to fall in the color development region of the high-temperature thermosensitive color developing layer 15, the color development region of the medium-temperature thermosensitive color developing layer 17, and the color development region of the low-temperature thermosensitive color developing layer 19, as a region ARHML indicated by hatching in FIG. 12.

By performing such control, the color of yellow (Y) corresponding to the high-temperature thermosensitive color developing layer 15, the color of magenta (M) corresponding to the medium-temperature thermosensitive color developing layer 17, and the color of cyan (C) corresponding to the low-temperature thermosensitive color developing layer 19 are developed. As a result, a color of black (dark gray) is developed in the full-color image region ARC.

Next, the following describes color development control in the monochrome image region ARM.

When recording in the full-color image region ARC ends, the control unit 42 controls the output control unit 43 and the irradiation position control unit 44, and performs image recording for the monochrome image region ARM to cause the light absorption color developing layer 12 to develop a color using the near infrared laser light LNIR based on the laser irradiation parameter value set at Step S13 (Step S18).

In this case, the near infrared laser light LNIR reaches the light absorption color developing layer 12 via the protection/function layer 20, the low-temperature thermosensitive color developing layer 19, the intermediate layer 18, the medium-temperature thermosensitive color developing layer 17, the intermediate layer 16, the high-temperature thermosensitive color developing layer 15, and the binder layer 14, not via the photothermal conversion layer 13, that is, without being absorbed by the photothermal conversion layer 13.

As a result, the pigment particles contained in the light absorption color developing layer 12 absorb the near infrared laser light LNIR as light and are carbonized to irreversibly develop a color of black.

The color of black developed by the light absorption color developing layer 12 has a higher contrast than that of the color of black (dark gray) developed in the full-color image region ARC, and can display an image such as a character more clearly.

Subsequently, the control unit 42 of the laser recording device 30 releases fixation of the recording medium 10 by the fixing device (not illustrated) (Step S19), carries out the recording medium 10 to a given carry-out position via the conveying device no illustrated), and ends the processing (Step S20).

As described above, according to the first embodiment, full-color/monochrome image recording can be performed by using a laser light source of a single wavelength. Additionally, according to the first embodiment, a postscript cannot be added using a thermal head, for example, so that the recording medium can be prevented from being altered, and security can be improved.

Second Embodiment

Next, the following describes the recording medium according to a second embodiment.

Figure 16:
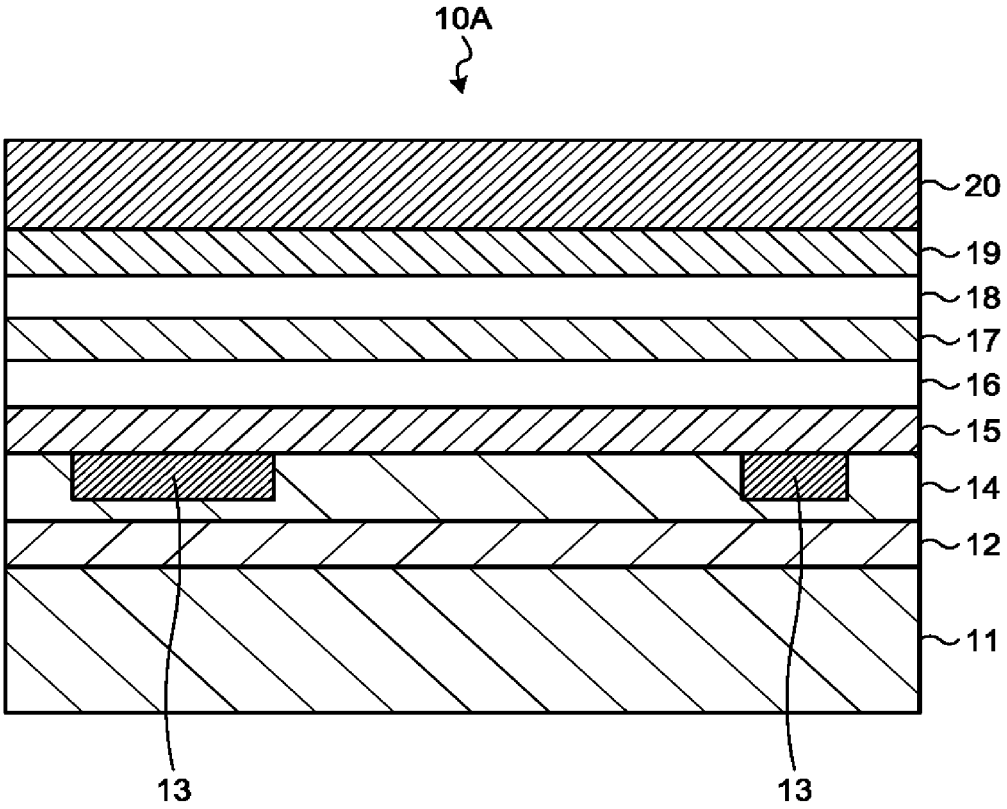
FIG. 16 is a cross-sectional view of a configuration example of a recording medium according to a second embodiment.

FIG. 16 is a cross-sectional view of a configuration example of the recording medium according to the second embodiment.

A recording medium 10A in the second embodiment is different from the recording medium 10 in the first embodiment in that the photothermal conversion layer 13 is located closer to the high-temperature thermosensitive color developing layer 15, not to the light absorption color developing layer 12.

With this configuration, in addition to the effect of the first embodiment, a heat transfer loss due to the binder layer 14 can be reduced in transferring the heat generated in the photothermal conversion layer 13 to the high-temperature thermosensitive color developing layer 15, and energy can be further saved.

Third Embodiment

Next, the following describes the recording medium according to a third embodiment.

Figure 17:
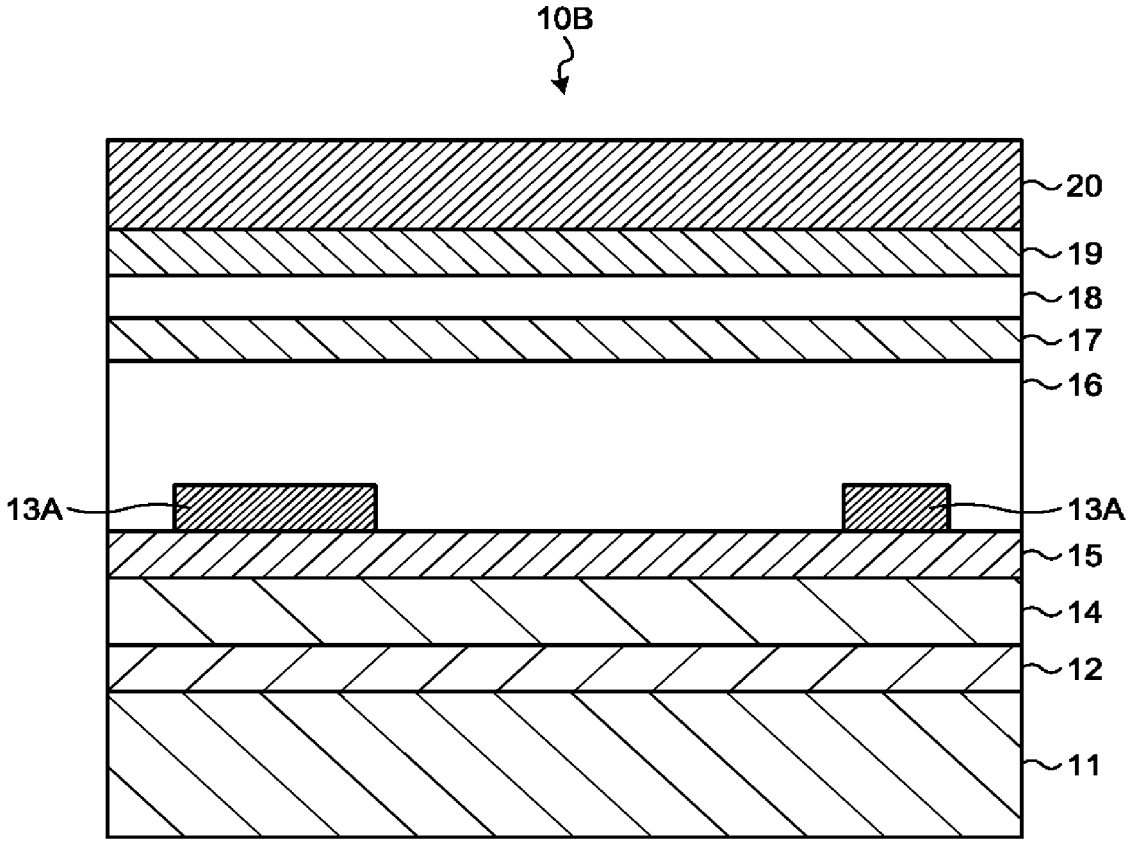
FIG. 17 is a cross-sectional view of a configuration example of a recording medium according to a third embodiment.

FIG. 17 is a cross-sectional view of a configuration example of the recording medium according to the third embodiment.

A recording medium 10B in the third embodiment is different from the recording medium 10 in the first embodiment in that the photothermal conversion layer 13A is closer to the intermediate layer 16 of the high-temperature thermosensitive color developing layer 15.

With this configuration, in addition to the effect of the first embodiment, in transferring the heat generated in the photothermal conversion layer 13A to the high-temperature thermosensitive color developing layer 15, the heat transfer loss due to the binder layer 14 can be reduced, and a transmission loss of the near infrared laser light LNIR for the photothermal conversion layer 13A can also be reduced. Thus, further energy saving can be achieved.

Modification of Third Embodiment

Next, the following describes the recording medium according to a modification of the third embodiment.

Figure 18:
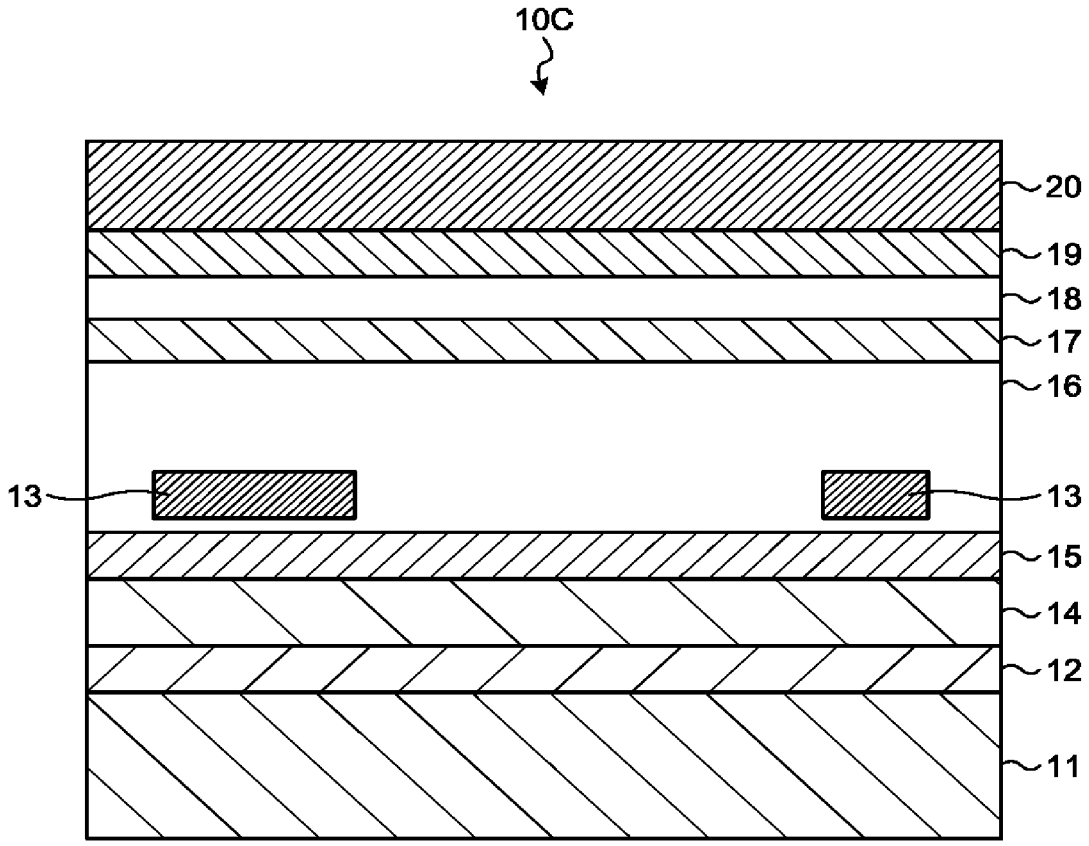
FIG. 18 is a cross-sectional view of a configuration example of a recording medium according to a modification of the third embodiment.

FIG. 18 is a cross-sectional view of a configuration example of the recording medium according to the modification of the third embodiment.

A recording medium 10C according to the modification of the third embodiment is different from the recording medium 10B in the third embodiment in that the photothermal conversion layer 13 is separated from the high-temperature thermosensitive color developing layer 15 by a given distance in the intermediate layer 16.

With this configuration, the same effect as that of the third embodiment can be obtained.

Fourth Embodiment

Next, the following describes the recording medium according to a fourth embodiment.

Figure 19:
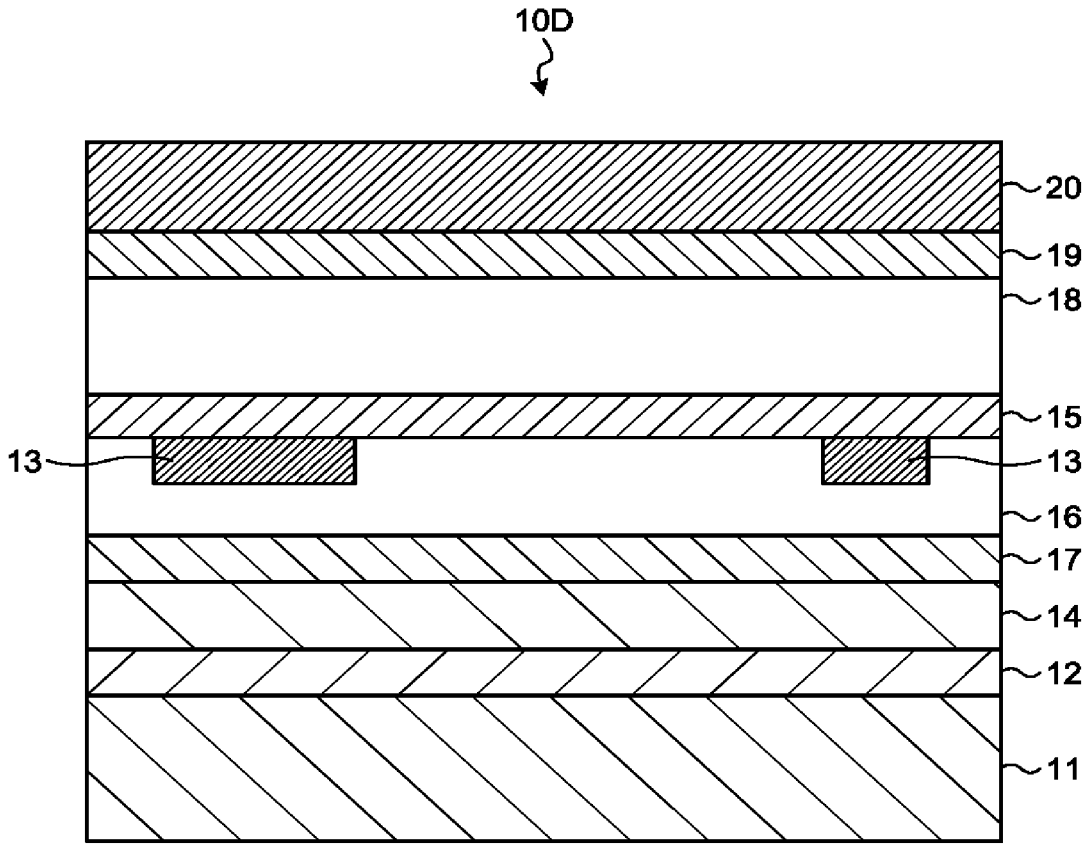
FIG. 19 is a cross-sectional view of a configuration example of a recording medium according to a fourth embodiment.

FIG. 19 is a cross-sectional view of a configuration example recording medium according to the fourth embodiment.

In FIG. 19, the same or like elements as those in the first embodiment in FIG. 2 are denoted by the same reference numerals.

A recording medium 10D according to the fourth embodiment, as illustrated in FIG. 19, includes the light absorption color developing layer 12 serving as the first color developing layer, the binder layer 14, the medium-temperature thermosensitive color developing layer 17 serving as the second color developing layer, the intermediate layer 16, the high-temperature thermosensitive color developing layer 15 serving as the second color developing layer, the photothermal conversion layer 13 closer to the high-temperature thermosensitive color developing layer 15 in the intermediate layer 16, the intermediate layer 18, the low-temperature thermosensitive color developing layer 19 serving as the second color developing layer, and the protection/function layer 20, laminated on the base material 11 in this order.

Also in this case, each of the high-temperature thermosensitive color developing layer 15, the medium-temperature thermosensitive color developing layer 17, and the low-temperature thermosensitive color developing layer 19 functions as a thermosensitive recording layer or which an image is recorded.

In the fourth embodiment, the thickness of the intermediate layer 16 is set based on an optimum transfer amount of thermal energy to the medium-temperature thermosensitive color developing layer 17, and the thickness of the intermediate layer 18 is set based on an optimum transfer amount of thermal energy to the low-temperature thermosensitive color developing layer 19 via the high-temperature thermosensitive color developing layer 15.

According to the fourth embodiment, in addition to the effect of the first embodiment, transfer efficiency of thermal energy can be further improved, and energy can be saved.

Fifth Embodiment

Figure 20A:
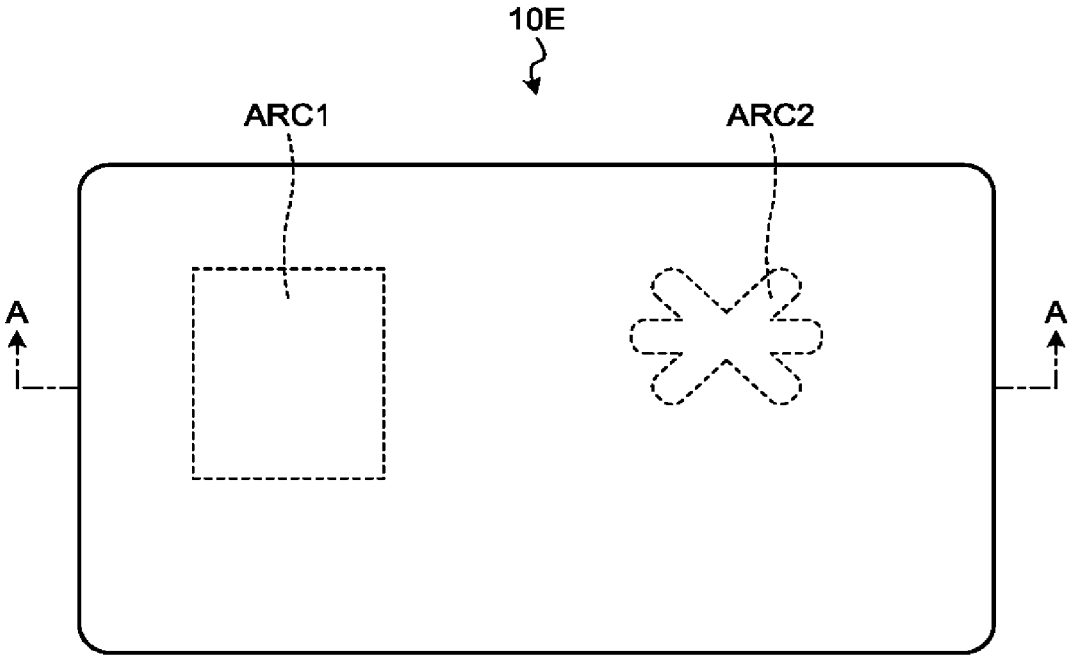
FIGS. 20A and 20B illustrate a recording medium according to a fifth embodiment.
Figure 20B:
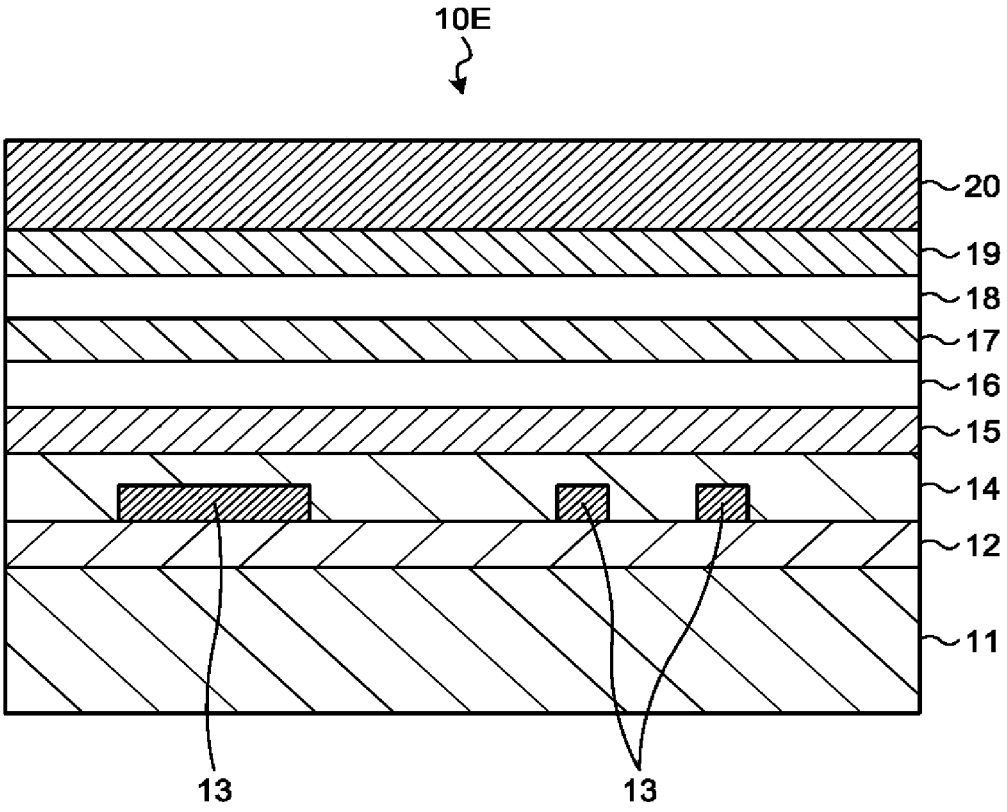

FIGS. 20A and 20B illustrate a recording medium according to a fifth embodiment.

FIG. 20A is a plan view, and FIG. 20B is an A-A cross-sectional view of FIG. 20A.

In the embodiments described above, the photothermal conversion layer 13 for forming the full-color image region ARC has a quadrangular shape (in FIG. 20, a rectangular shape) in a plan view as a full-color image region ARC1, but the embodiment is not limited thereto. The photothermal conversion layer 13 can have an optional shape as a full-color image region ARC2 in a recording medium 10E according to the fifth embodiment illustrated in FIG. 20.

The optional shape can be a desired shape such as a circular shape, an elliptic shape, a polygonal shape, a star shape, an animal shape, a map shape, and a human figure shape.

In this case, in the recording medium 10E, the photothermal conversion layer 13 is preferably formed by a printing system. As the printing system, a general printing system can be used such as ink-jet printing, offset printing, relief printing, screen printing, and intaglio printing.

According to the fifth embodiment, authenticity determination can be facilitated by varying the shape of the full-color image region ARC2 for each publication date of the recording medium.

Sixth Embodiment

Figure 21:
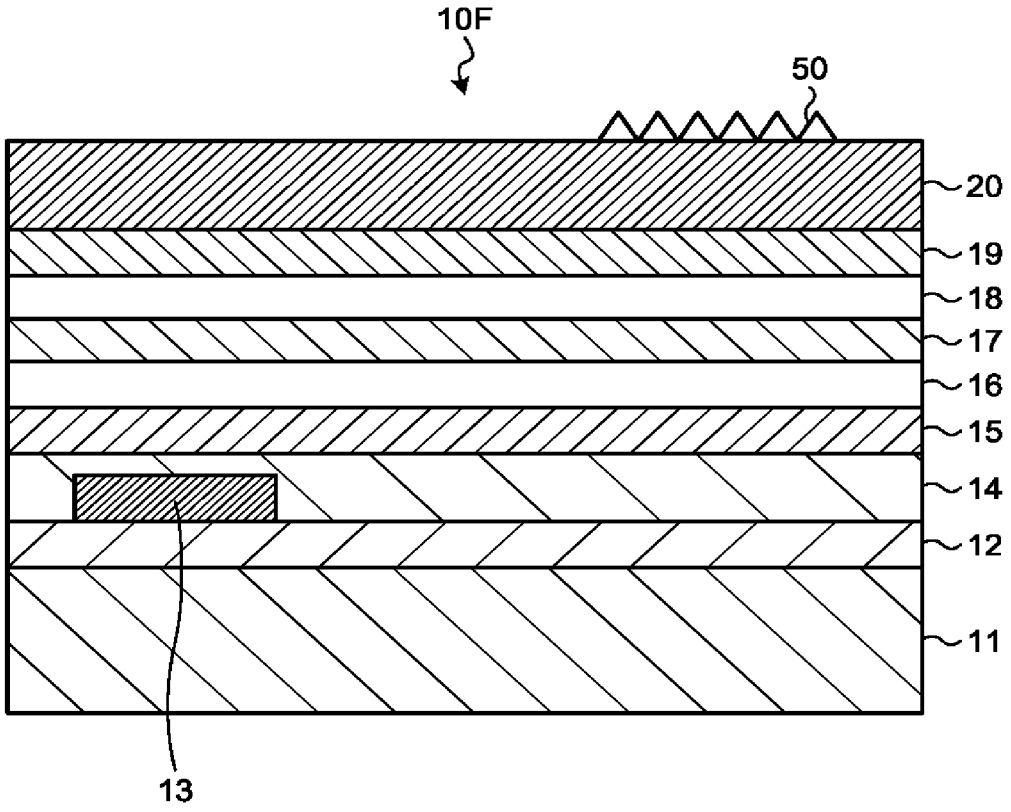
FIG. 21 is an explanatory diagram of a recording medium according to a sixth embodiment.

FIG. 21 is an explanatory diagram of the recording medium according to a sixth embodiment.

A recording medium 10F in the sixth embodiment is different from the embodiments described above in additionally including a lenticular lens 50 on the protection/function layer 20 or integrally with the protection/function layer 20.

With this configuration, by performing image formation while varying an irradiation direction of the near infrared laser light LNIR at the time of forming an image on the recording medium 10F, an image to be displayed can be switched depending on a visual recognition angle.

In the example of FIG. 21, the lenticular lens 50 is placed in a region corresponding to the monochrome image region ARM including no photothermal conversion layer 13, so that a recordable image is a monochrome image.

Figure 22:
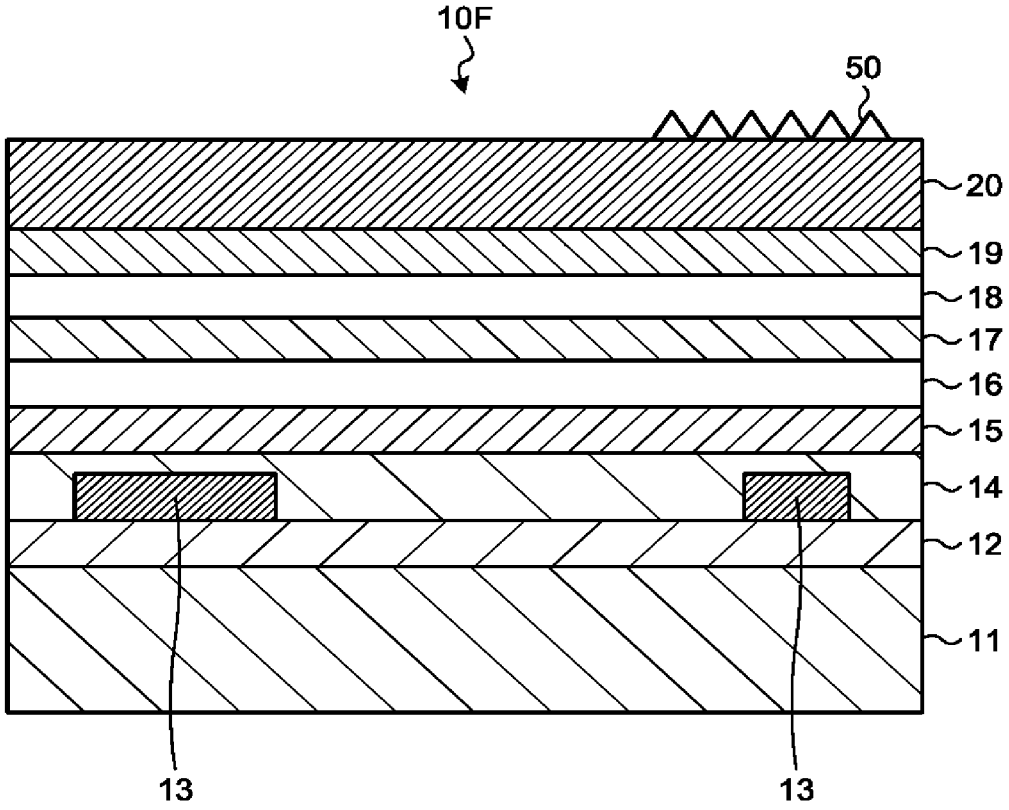
FIG. 22 is an explanatory diagram of a modification of the recording medium in the sixth embodiment.

FIG. 22 is an explanatory diagram of a modification of the recording medium in the sixth embodiment.

As illustrated in FIG. 22, the recording medium can be configured to form a full-color image by arranging the photothermal conversion layer 13 in a recordable region of the lenticular lens 50.

According to the sixth embodiment, functionality of the recording medium can be improved.

Additionally, image formation is required to be performed while varying the irradiation direction of the near infrared laser light LNIR depending on an image to be visually recognized, so that the recording medium is difficult to be forged, and authenticity determination for the recording medium can be facilitated.

Seventh Embodiment

Figure 23:
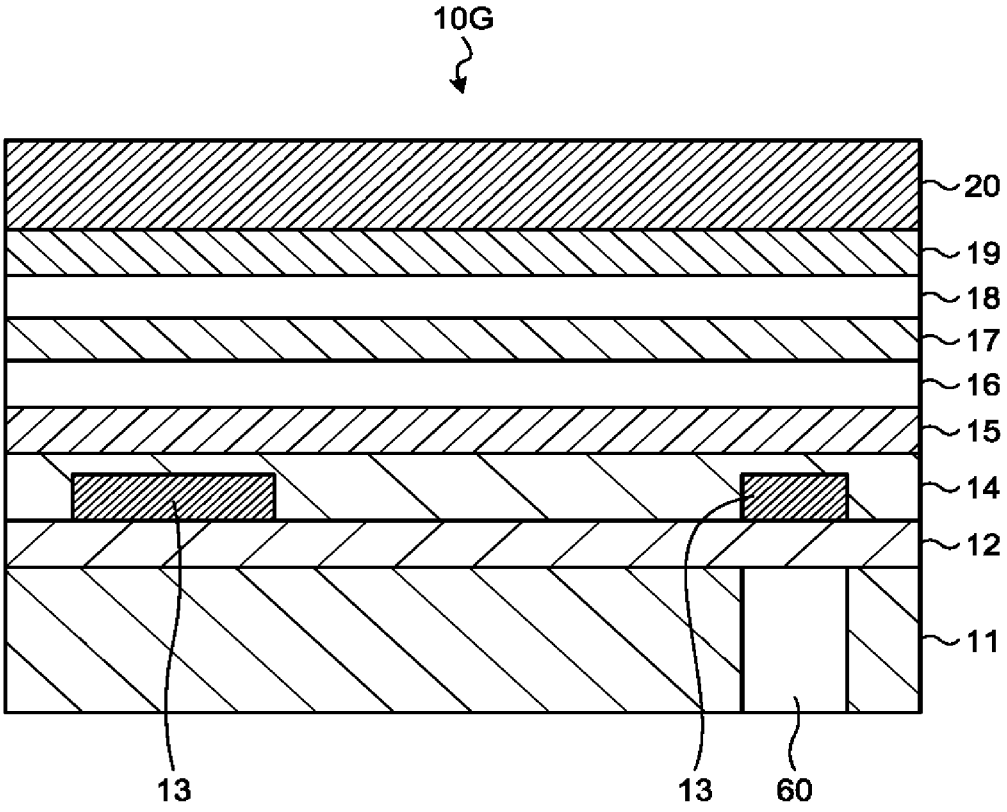
FIG. 23 is a cross-sectional view of a recording medium according to a seventh embodiment.

FIG. 23 is a cross-sectional view of the recording medium according to a seventh embodiment.

A recording medium 10G in the seventh embodiment is different from the embodiments described above in additionally including a transparent base material 60. The transparent base material 60 is part of the base material 11 and formed of a transparent material.

With this configuration, it is possible to facilitate authenticity determination by determining whether an image formed on the recording medium 10G is the same as that on a proper recording medium from the baste material 11.

Figure 24:
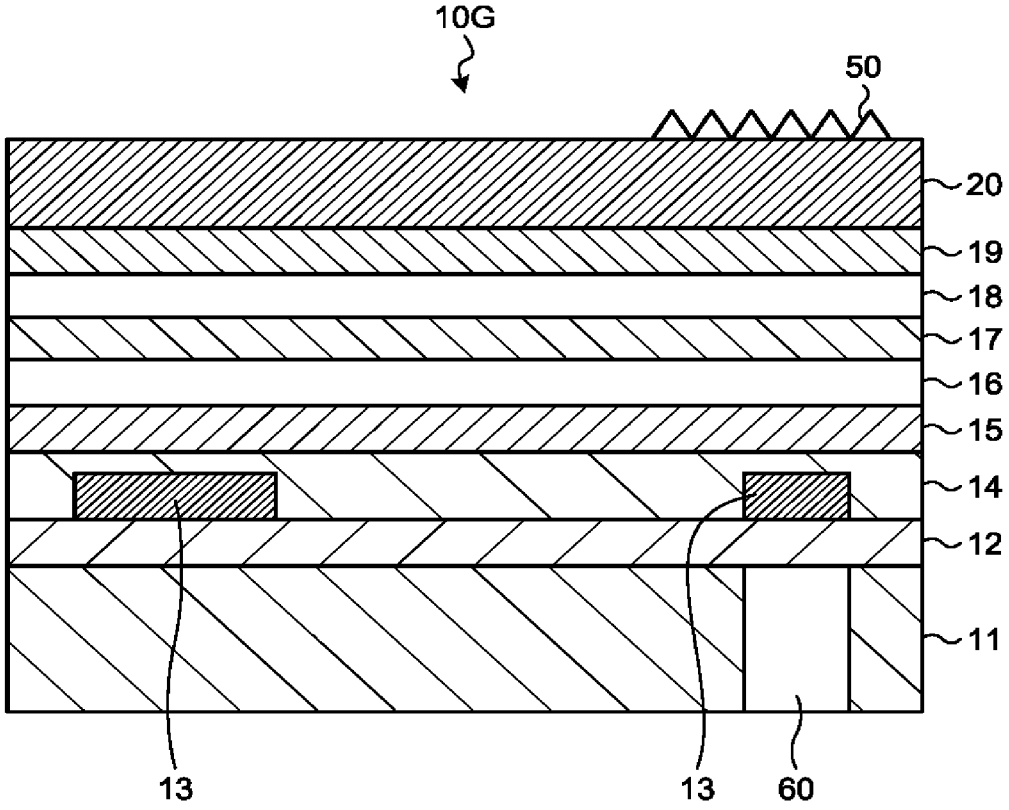
FIG. 24 is an explanatory diagram of a modification of the recording medium in the seventh embodiment.

FIG. 24 is an explanatory diagram of modification of the recording medium in the seventh embodiment.

The recording medium 10G according to the modification of the seventh embodiment is different from that in the seventh embodiment illustrated in FIG. 23 in including the lenticular lens 50 on the protection/function layer 20 or integrally with the protection/function layer 20.

With this configuration, by performing image formation while varying the irradiation direction of the near infrared laser light LNIR at the time of forming an image on the recording medium 10F, an image to be displayed can be switched depending on the visual recognition angle.

In the example of FIG. 24, the photothermal conversion layer 13 is located in the recordable region of the lenticular lens 50.

Thus, a dot pattern of a full-color image that is formed via the lenticular lens 50 is a dot pattern specific to a formed image, so that authenticity determination can be easily performed, and a forgery or an imitation can be detected to be excluded.

Eighth Embodiment

Figure 25:
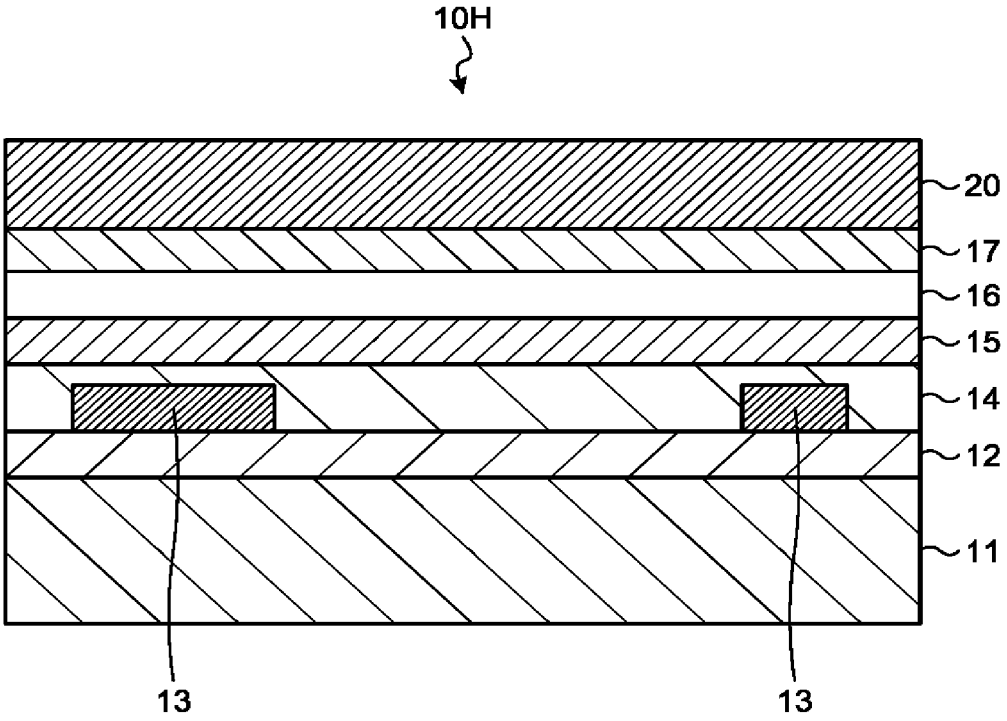
FIG. 25 is a cross-sectional view of a recording medium according to an eighth embodiment.

FIG. 25 is a cross-sectional view of the recording medium according to an eighth embodiment.

A recording medium 10H in the eighth embodiment is different from the embodiments described above in including the high-temperature thermosensitive color developing layer 15 and the medium-temperature thermosensitive color developing layer 17 as thermosensitive color developing layers and excluding the low-temperature thermosensitive color developing layer 19.

Because of this, a recording medium that cannot display in full color but can display a multicolored image can be provided at low cost.

FIG. 25 illustrates the example of no low-temperature thermosensitive color developing layer 19. Alternatively, the recording medium can be configured to include the low-temperature thermosensitive color developing layer 19 and any one of the high-temperature thermosensitive color developing layer 15 and the medium-temperature thermosensitive color developing layer 17.

Ninth Embodiment

Figure 26:
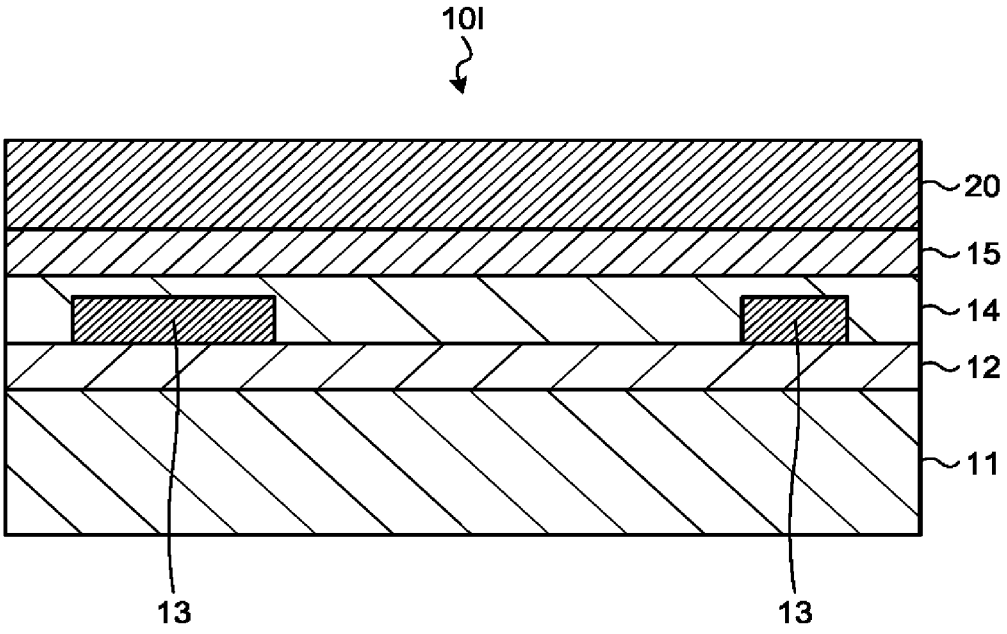
FIG. 26 is a cross-sectional view of a recording medium according to a ninth embodiment.

FIG. 26 is a cross-sectional view of the recording medium according to a ninth embodiment.

A recording medium 10I in the ninth embodiment is different from the above embodiments except the eighth embodiment in including only the high-temperature thermosensitive color developing layer 15 as the thermosensitive color developing layer, and excluding the medium-temperature thermosensitive color developing layer 17 and the temperature thermosensitive color developing layer 19.

Due to this, a recording medium that can display a two-color image can be provided at low cost although it cannot display in full color.

FIG. 26 illustrates the example of the recording medium without the medium-temperature thermosensitive color developing layer 17 and the low-temperature thermosensitive color developing layer 19. Alternatively, the recording medium can be configured to include only one of the high-temperature thermosensitive color developing layer 15, the medium-temperature thermosensitive color developing layer 17, and the low-temperature thermosensitive color developing layer 19 without the other two.

Tenth Embodiment

Figure 27:
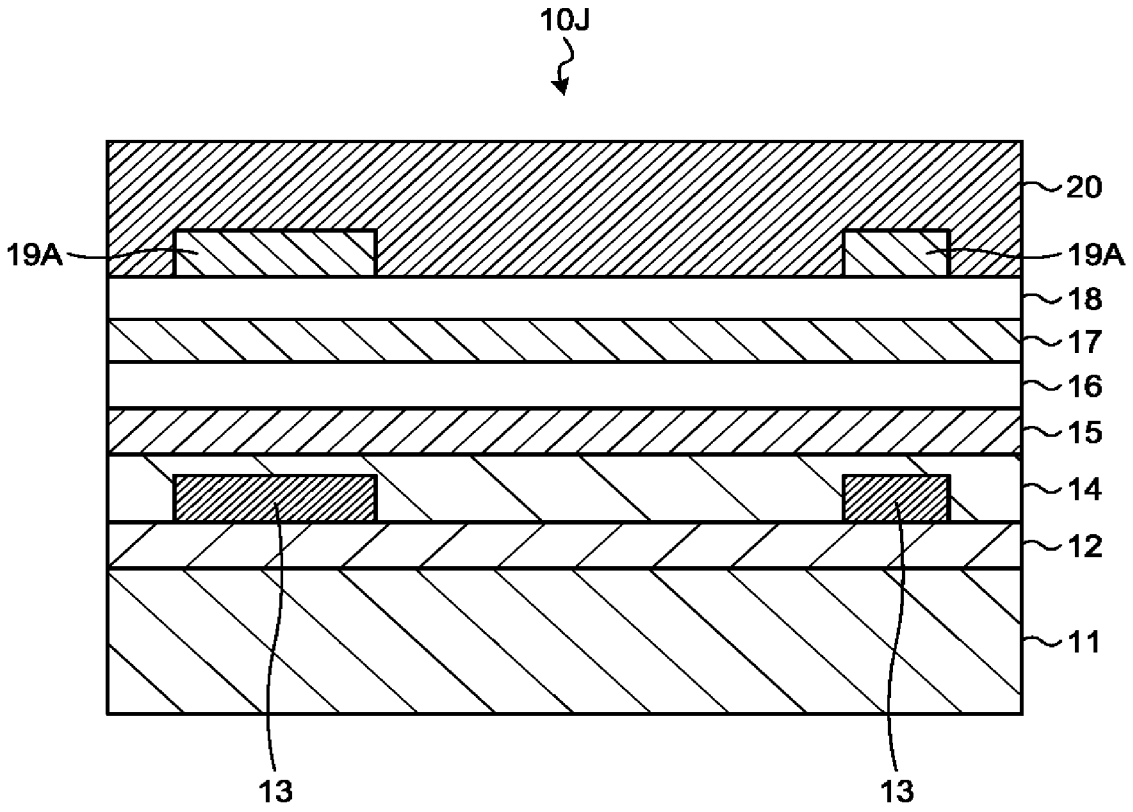
FIG. 27 is a cross-sectional view of a recording medium according to a tenth embodiment.

FIG. 27 is a cross-sectional view of the recording medium according to a ninth embodiment.

A recording medium 10J in the ninth embodiment is different from the embodiments described above in that a low-temperature thermosensitive color developing layer 19A is formed only in the area of the full-color image region ARC, while the thermosensitive color developing layer is formed on the entire surface of the recording medium in a plan view in the embodiments described above.

According to the tenth embodiment, only a desired region of the recording medium can be set to the full-color image region, so that forgery using another recording medium can be prevented by causing a proper full-color image region to be different for each type of the recording medium.

Eleventh Embodiment

In the laser recording device 30 according to the first embodiment described above, the light absorption color developing layer 12 cannot develop a color in the region of the photothermal conversion layer 13, that is, in the full-color image region ARC. However, a laser recording device 30A according to an eleventh embodiment causes the light absorption color developing layer 12 to develop a color in at least part of the full-color image region ARC of the photothermal conversion layer 13.

Figure 28:
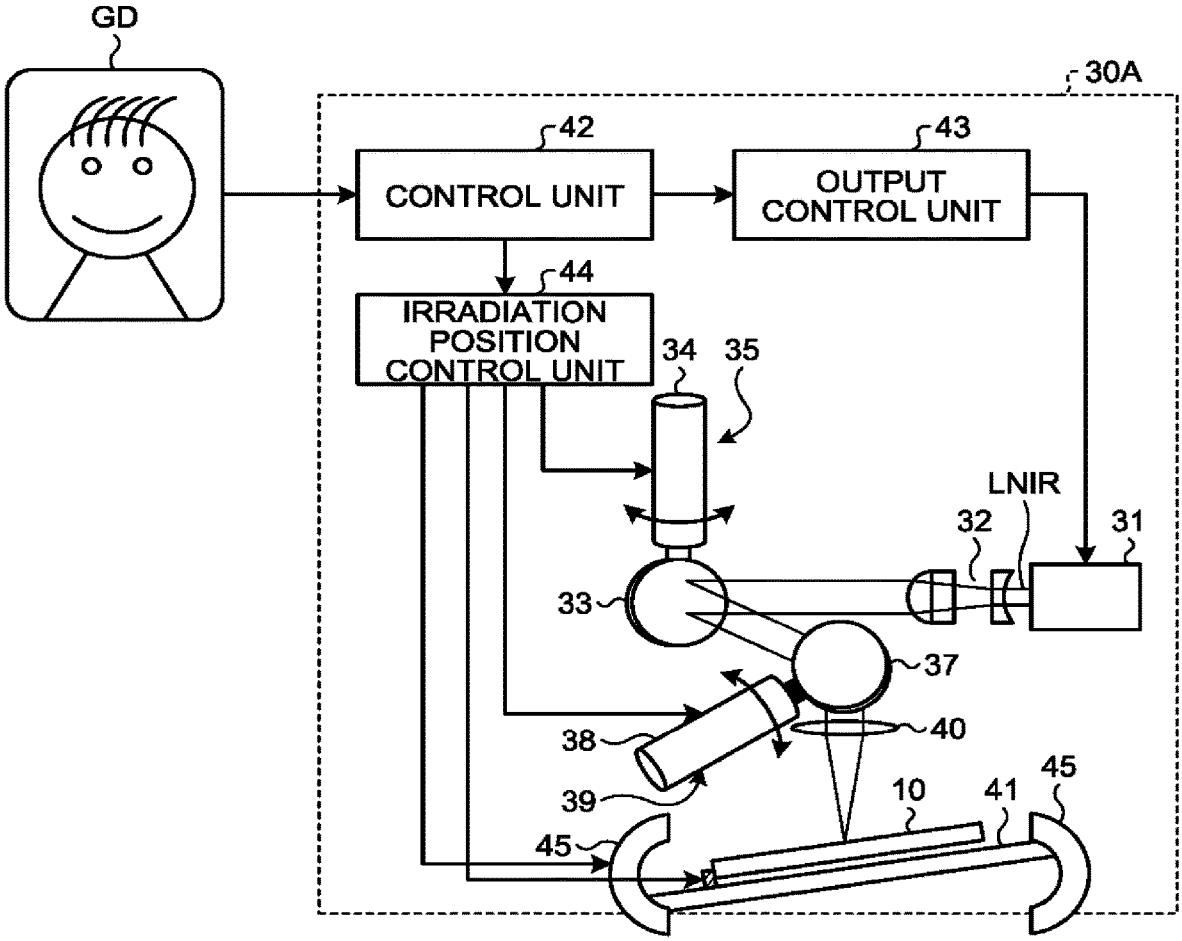
FIG. 28 is an overview block diagram of a laser recording device according to an eleventh embodiment.

FIG. 28 is an overview block diagram of the laser recording device according to the eleventh embodiment.

In FIG. 28, the same or like elements as those in the first embodiment in FIG. 1 are denoted by the same reference numerals.

The laser recording device 30A in the eleventh embodiment is different from the laser recording device in the first embodiment in additionally including an incident-angle changing device 45. The incident-angle changing device 45 can effectively change an incident angle at the time when the near infrared laser light LNIR enter the light absorption color developing layer 12 located on the back surface of the photothermal conversion layer 13 by inclining, in an optional direction, the stage 41 that conveys and holds the recording medium 10 at a given position under control of the irradiation position control unit 44.

Figure 29:
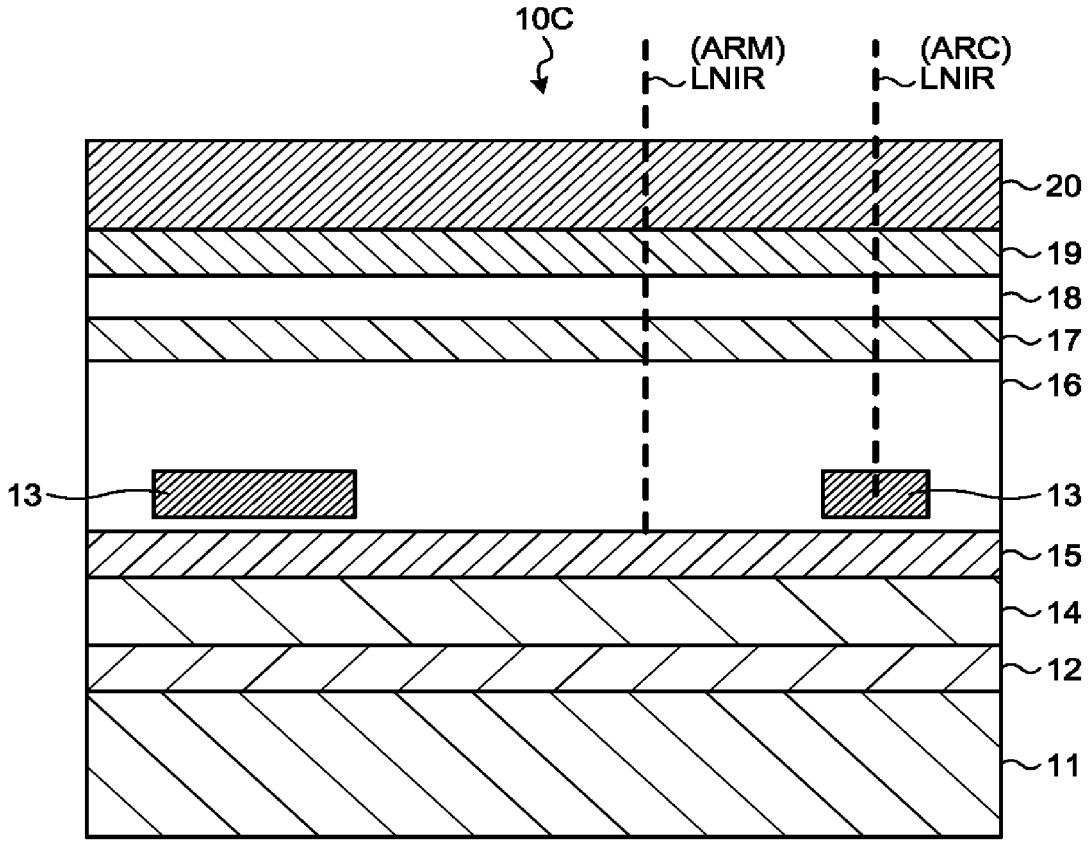
FIG. 29 is an explanatory diagram of an irradiation state while the recording medium is not inclined.

FIG. 29 is an explanatory diagram of an irradiation state with no inclination of the recording medium.

To form an image in a region corresponding to the monochrome image region ARM including no photothermal conversion layer 13 as illustrated in the center of FIG. 29, and in a region corresponding to the full-color image region ARC including the photothermal conversion layer 13 as illustrated in the right side of FIG. 29, the near infrared laser light LNIR can vertically enter the recording surface of the recording medium 10C for normal recording while maintaining a horizontal state of the recording medium (in FIG. 29, the recording medium 10C) not inclined by the incident-angle changing device 45.

Figure 30:
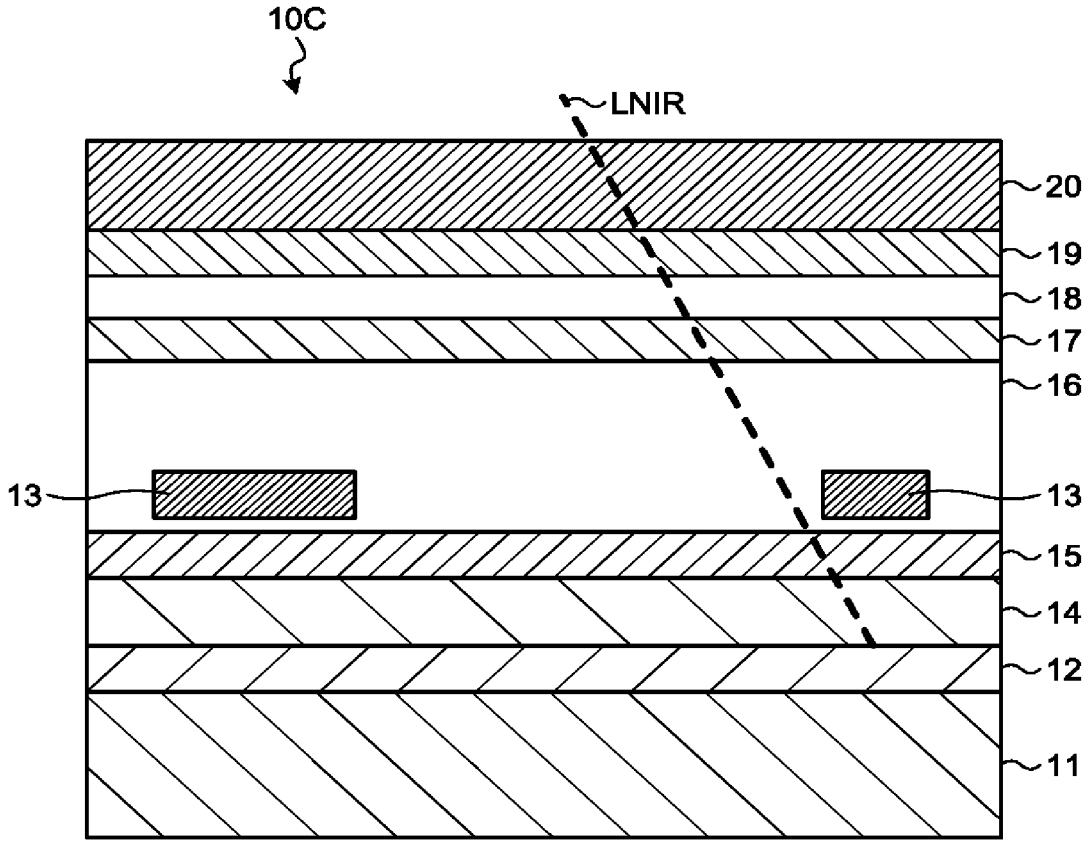
FIG. 30 is an explanatory diagram of an irradiation state while the recording medium is inclined.

FIG. 30 is an explanatory diagram of an irradiation state while the recording medium is inclined.

In FIG. 30, the recording medium 10C is inclined by the incident-angle changing device 45 in practice, but the recording medium 10C is illustrated in a horizontal state to be easily understood.

That is, with the recording medium 10C inclined by the incident-angle changing device 45, the near infrared laser light LNIR effectively and obliquely enters to record information on the light absorption color developing layer 12 located on the back side of the region corresponding to the full-color image region ARC including the photothermal conversion layer 13.

In this manner, with the laser recording device 30A in the eleventh embodiment, images can be formed by causing the light absorption color developing layer 12 to develop a color in at least part of the full-color image region ARC including the photothermal conversion layer 13, which makes it difficult to alter and forge the recording.

Twelfth Embodiment

In the embodiments described above, the recording medium is a single item. A twelfth embodiment describes a card-like recording medium including the recording medium and a carrier that carries the recording medium, i.e., a member having card shape such as paper, plastic, metal, and ceramics.

In the following, for better understanding, the recording medium 10 is exemplified as the recording medium held by the carrier.

Figure 31:
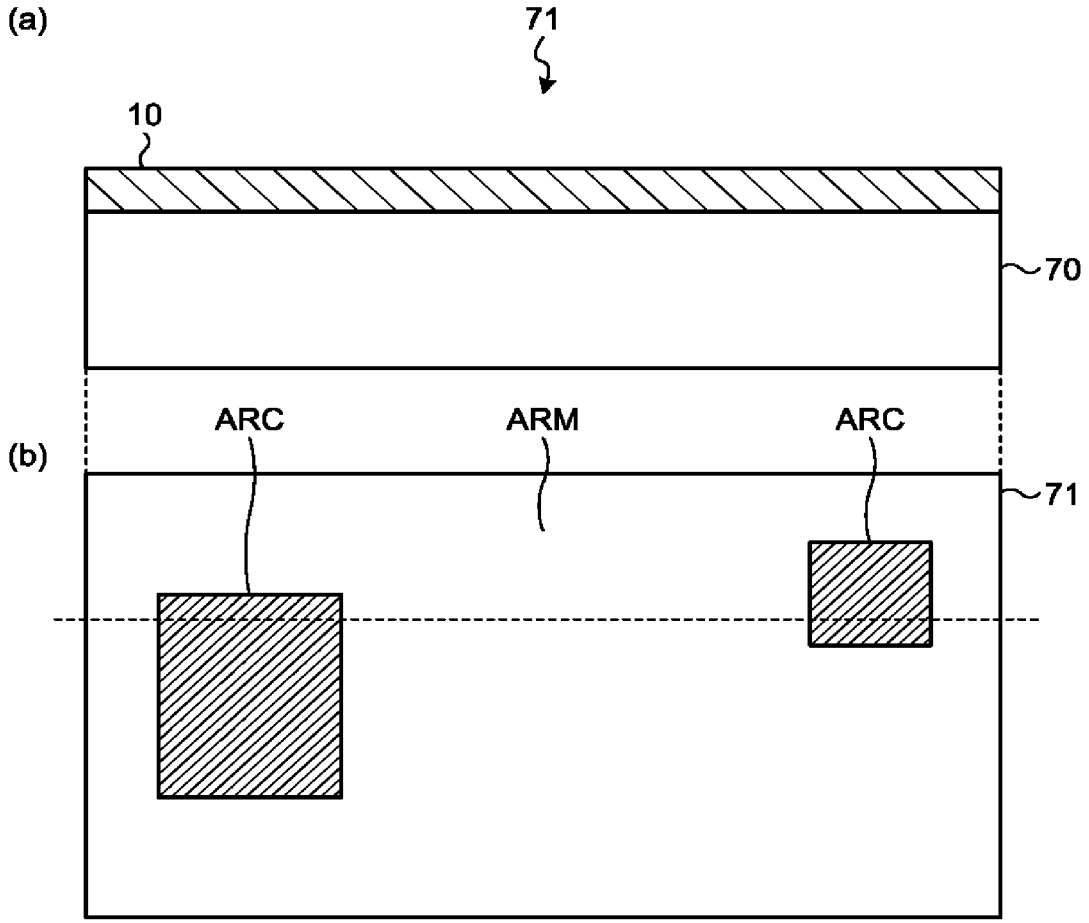
FIG. 31 is an explanatory diagram of a card-like recording medium according to a twelfth embodiment.

FIG. 31 is an explanatory diagram of the card-like recording medium according to the twelfth embodiment.

(a) in FIG. 31 is a cross-sectional view, and (b) in FIG. 31 is a plan view.

(a) in FIG. 31 is a cross-sectional view of a dashed line area of FIG. 31B.

As illustrated in (a) in FIG. 31, the recording medium 10 is carried by a carrier 70 to form a card-like recording medium 71.

In this way, according to the twelfth embodiment, the recording medium 10 is carried by the carrier 70, so that ruggedness is improved, and the recording medium 10 can be kept having high reliability for a long period.

First Modification of Twelfth Embodiment

Figure 32:
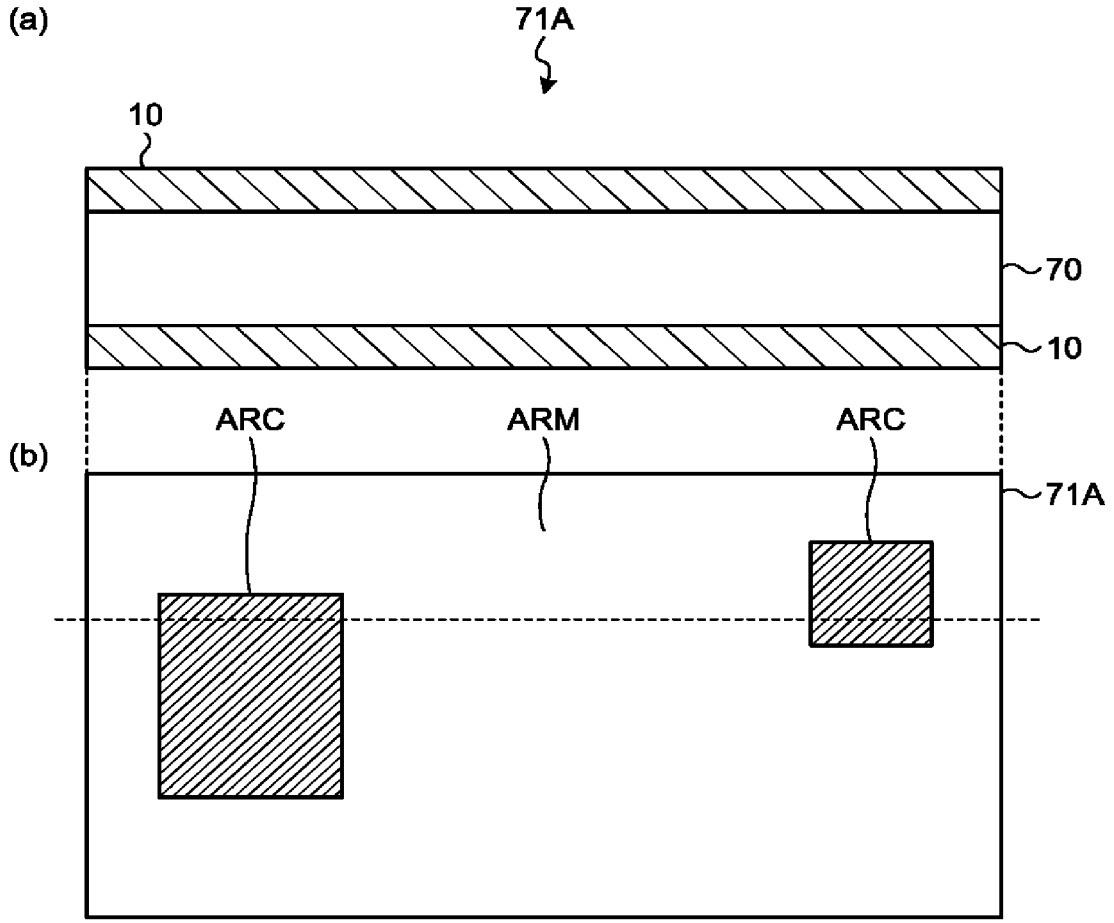
FIG. 32 is an explanatory diagram of a card-like recording medium according to a first modification of the twelfth embodiment.

FIG. 32 is an explanatory diagram of the card-like recording medium according to a first modification of the twelfth embodiment.

(a) in FIG. 32 is a cross-sectional view, and in FIG. 32 is a plan view.

(a) in FIG. 32 is a cross-sectional view of a dashed line area of (b) in FIG. 32.

A card-like recording medium 71A according to the first modification of the twelfth embodiment is different from the twelfth embodiment in that two recording mediums 10 are carried by both surfaces of the carrier 70, respectively.

With this configuration, in addition the effect of the twelfth embodiment, recording can be performed on both surfaces of the card-like recording medium 71A. Furthermore, strength of the card-like recording medium 71A can be improved, and the card-like recording medium 71A can be prevented from being deformed.

Second Modification of Twelfth Embodiment

FIG. 33 is an explanatory diagram of the card-like recording medium according to a second modification of the twelfth embodiment.

Figure 33A:
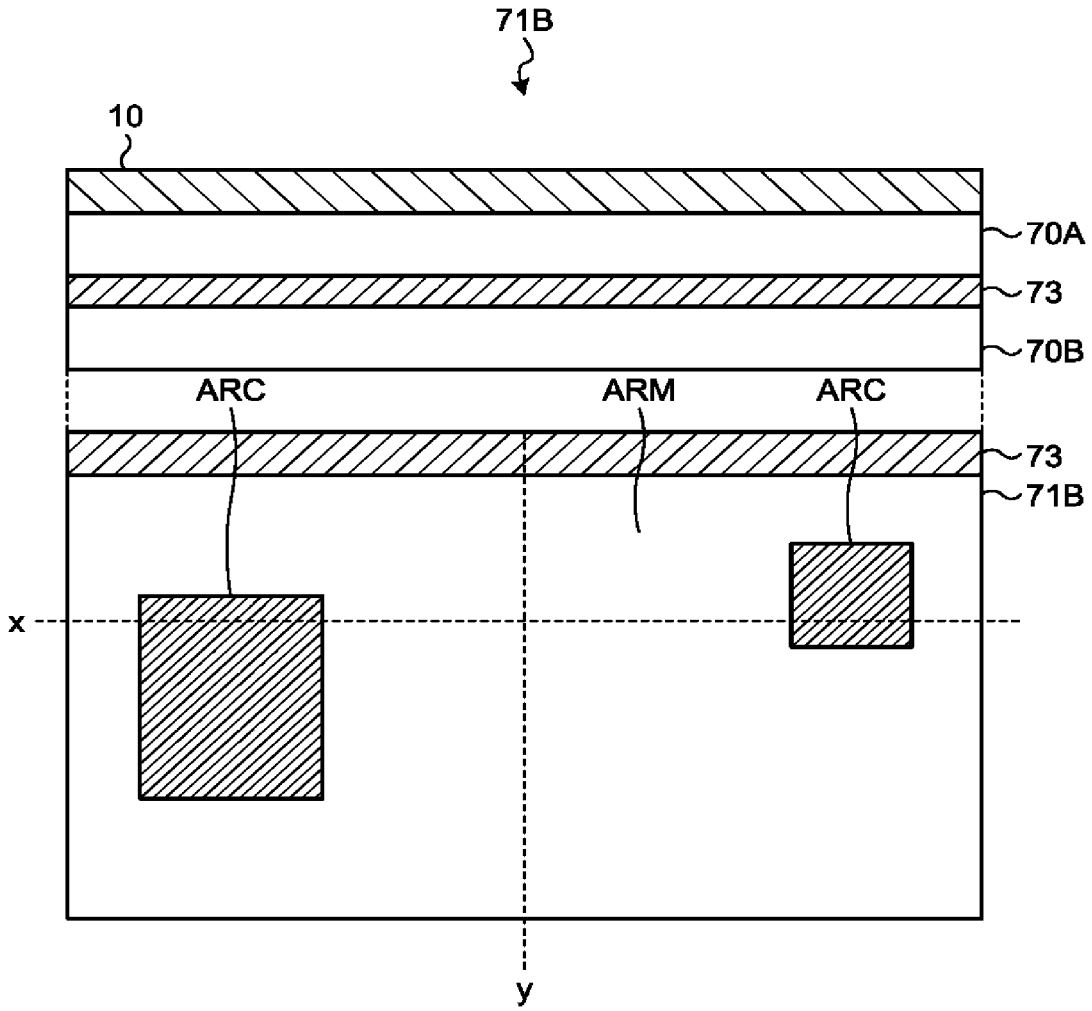
FIGS. 33A and 33B illustrate a card-like recording medium according to a second modification of the twelfth embodiment.
Figure 33B:
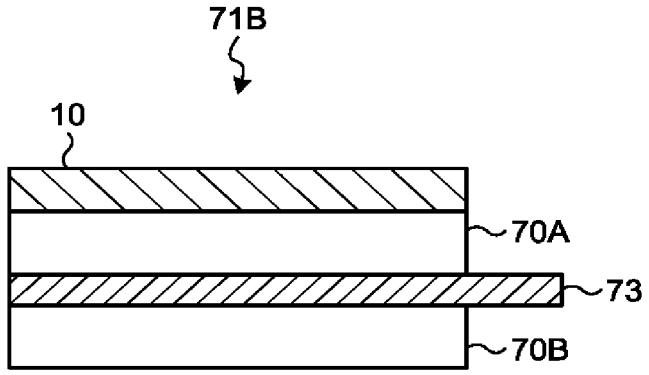

(a) in FIG. 33A a first cross-sectional view, (b) in FIG. 33 is a plan view, and FIG. 33B is a second cross-sectional view.

(a) in FIG. 33A is a cross-sectional view of a dashed line x of (b) in FIG. 33, and FIG. 33C is a cross-sectional view of a dashed line area y of (b) in FIG. 31.

A card-like recording medium 71B according to the second modification of the twelfth embodiment is different from the twelfth embodiment in that the recording medium 10 is carried by two carriers 70A and 70B holding a hinge 73 therebetween.

In this case, in addition to the effect of the twelfth embodiment, by filing one or a plurality of card-like recording mediums 71B to a booklet at the hinge 73, the card-like recording mediums 71B are difficult to be removed from the booklet. Thus, alteration and the like can be further prevented, and security can be improved.

Third Modification of Twelfth Embodiment

Figure 34:
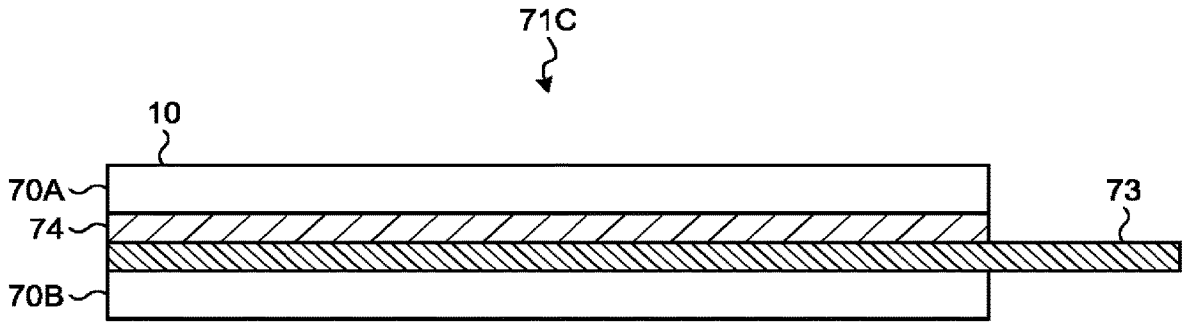
FIG. 34 is an explanatory diagram of a card-like recording medium according to a third modification of the twelfth embodiment.

FIG. 34 is an explanatory diagram of the card-like recording medium according to a third modification of the twelfth embodiment.

A card-like recording medium 71C according to a third modification of the twelfth embodiment is different from the twelfth embodiment in that the recording medium 10 is held by the two carriers 70A and 70B placing the hinge 73 and a card core 74 as an IC card in-between.

In this case, in addition to the effect of the twelfth embodiment, a high-functionality card-like recording medium can be obtained by integrating various functions into the card core 74, and security can be further improved by digitizing and encoding recording data.

Fourth Modification of Twelfth Embodiment

Figure 35:
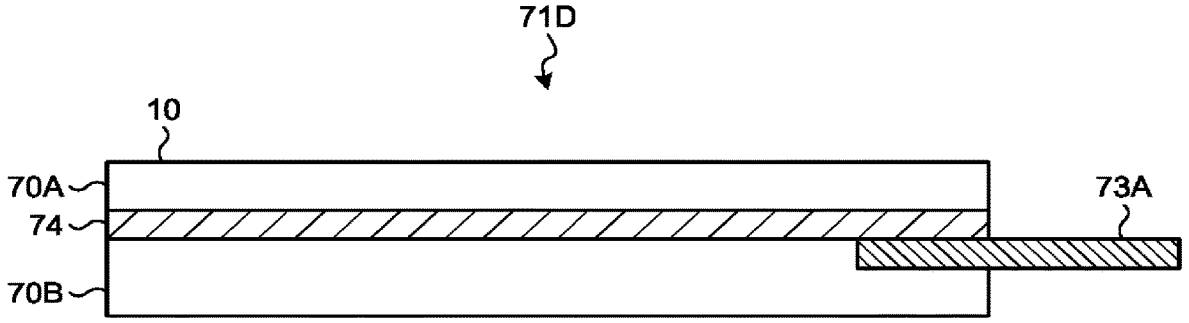
FIG. 35 is an explanatory diagram of a card-like recording medium according to a fourth modification of the twelfth embodiment.

FIG. 35 is an explanatory diagram of the card-like recording medium according to a fourth modification of the twelfth embodiment.

A card-like recording medium 71D according to the fourth modification of the twelfth embodiment is different from the third modification of the twelfth embodiment in FIG. 34 in including a short hinge 73A in place of the hinge 73.

According to the fourth modification of the twelfth embodiment, in addition to the effect of the third modification of the twelfth embodiment, an increase in the thickness of the card-like recording medium can be suppressed, and the number of mediums to be filed can be increased.

Modification of Embodiments

The above embodiments have described the example of two to four color developing layers. However, the embodiments can also be applied to five or more color developing layers.

The above embodiments have described four-color (CMYK) recording as an example. However, the embodiments can also be applied to seven-color recording on seven-color developing layers including cyan (C), magenta (M), yellow (Y), red (R), green (G), blue (F), and black (K), for example.

The above embodiments have described the example of the near infrared laser light as the laser light. However, the laser light can be near UV laser light and far UV laser light depending on an absorption wavelength of the photothermal conversion layer.

The above embodiments have described the example of the control unit 42, the output control unit 43, and the irradiation position control unit 44 as independent elements. However, the control unit 42, the output control unit 43, and the irradiation position control unit 44 may be configured as a computer including a MPU, a ROM, and a RAM to execute their functions by a computer program via various interfaces.

In this case, the computer program executed by the computer may be recorded and provided in an installable or executable file format on a computer-readable recording medium such as a semiconductor recording device such as a CD-ROM, a digital versatile disc (DVD), and a USB memory.

The computer program executed by the computer may be stored in the computer connected to a network such as the Internet and provided by being downloaded via the network. Furthermore, the computer program executed by the control unit 52 may be provided or distributed via a network such as the Internet.

The computer program executed by the computer may be embedded and provided in a ROM, for example.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A recording medium comprising:

a base material;

a first color developing layer that is laminated on the base material, and absorbs light having a given wavelength to develop a color;

a photothermal conversion layer that is laminated closer to an incident side of the light having a given wavelength than the first color developing layer, transmits visible light, and absorbs the light having a given wavelength for photothermal conversion; and a second color developing layer that is laminated closer to the incident side of the light having a given wavelength than the first color developing layer, transmits visible light and the light having a given wavelength, and develops a color by heat converted by the photothermal conversion layer, wherein the second color developing layer comprises a plurality of second color developing layers, the first color developing layer forms a monochrome recording layer, the plurality of second color developing layers form a multicolor recording layer, the recording medium has a recording surface including a monochrome image region and a multicolor image region, and the photothermal conversion layer is located corresponding to the multicolor image region.

2. The recording medium according to claim 1, wherein each of the plurality of second color developing layers is separated from another of the plurality of second color developing layers via an intermediate layer that adjusts an amount of heat transfer, and has a different color development threshold temperature from the other of the plurality of second color developing layers.

3. The recording medium according to claim 2, wherein the plurality of second color developing layers are laminated such that the higher the color development threshold temperature that one of the plurality of second color developing layers exhibits, the larger the amount of heat the one of the plurality of second color developing layer receives from the photothermal conversion layer.

4. The recording medium according to claim 2, wherein the plurality of second color developing layers are laminated such that the lower the color development threshold temperature that one of the plurality of second color developing layers exhibits, the further the one of the plurality of second color developing layer is from the photothermal conversion layer.

5. The recording medium according to claim 1, wherein each of the plurality of second color developing layers is a thermosensitive color developing layer that transmits the light having a given wavelength and visible light.

6. The recording medium according to claim 1, wherein the photothermal conversion layer contains a phthalocyanine-based material as a photothermal conversion material.

7. A recording medium comprising:

a base material;

a first color developing layer that is laminated on the base material, and absorbs light having a given wavelength to develop a color;

a photothermal conversion layer that is laminated closer to an incident side of the light having a given wavelength than the first color developing layer, transmits visible light, and absorbs the light having a given wavelength for photothermal conversion; and a second color developing layer that is laminated closer to the incident side of the light having a given wavelength than the first color developing layer, transmits visible light and the light having a given wavelength, and develops a color by heat converted by the photothermal conversion layer, wherein the second color developing layer comprises a plurality of second color developing layers, each of the plurality of second color developing layers is separated from another of the plurality of second color developing layers via an intermediate layer that adjusts an amount of heat transfer, and has a different color development threshold temperature from the other of the plurality of second color developing layers, the first color developing layer forms a monochrome recording layer, the plurality of second color developing layers form a multicolor recording layer, the number of the plurality of second color developing layers is at least three, the plurality of second color developing layers form a full-color recording layer, the recording medium has a recording surface including a monochrome image region and a multicolor image region, and the photothermal conversion layer is located corresponding to the multicolor image region.

* * * * *